US008448482B2

(12) United States Patent
Schuck et al.

(10) Patent No.: US 8,448,482 B2
(45) Date of Patent: May 28, 2013

(54) DOOR HOOK FOR A HOUSEHOLD APPLIANCE DOOR

(75) Inventors: Rolf Schuck, New Bern, NC (US); Oliver Schöne, New Bern, NC (US)

(73) Assignee: BSH Home Appliances Corporation, Irvine, CA (US)

( * ) Notice: Subject to any disclaimer, the term of this patent is extended or adjusted under 35 U.S.C. 154(b) by 971 days.

(21) Appl. No.: 12/533,033

(22) Filed: Jul. 31, 2009

(65) Prior Publication Data

US 2011/0023560 A1 Feb. 3, 2011

(51) Int. Cl.
*D06F 39/14* (2006.01)
*D06F 37/28* (2006.01)

(52) U.S. Cl.
CPC ..... *D06F 39/14* (2013.01); *D06F 37/28* (2013.01)
USPC ..... 68/196

(58) Field of Classification Search
CPC ..... D06F 39/14; D06F 37/28
USPC ..... 68/12.26, 196; 292/17, 19
See application file for complete search history.

(56) References Cited

U.S. PATENT DOCUMENTS

| | | | | |
|---|---|---|---|---|
| 3,988,808 | A * | 11/1976 | Poe et al. | 24/326 |
| 6,568,719 | B2 * | 5/2003 | Buscella | 292/85 |
| 6,685,241 | B2 * | 2/2004 | Bollmann | 292/341.16 |
| 7,677,064 | B2 * | 3/2010 | Kim et al. | 68/196 |
| 7,934,404 | B2 * | 5/2011 | Ha | 68/196 |
| 8,104,848 | B2 * | 1/2012 | Yoon | 312/222 |
| 2004/0083769 | A1 * | 5/2004 | Kim et al. | 68/12.02 |
| 2004/0104582 | A1 | 6/2004 | Hwang | |
| 2004/0177656 | A1 * | 9/2004 | Kwon | 68/196 |
| 2004/0244435 | A1 * | 12/2004 | Kim | 68/12.26 |
| 2005/0225094 | A1 * | 10/2005 | Lewis et al. | 292/19 |
| 2007/0130998 | A1 * | 6/2007 | Cho et al. | 68/12.01 |
| 2009/0039657 | A1 * | 2/2009 | Schuck | 292/300 |
| 2009/0167126 | A1 | 7/2009 | Yoon | |

FOREIGN PATENT DOCUMENTS

| | | | |
|---|---|---|---|
| DE | 19636925 | A1 * | 3/1998 |
| EP | 481503 | A * | 4/1992 |
| EP | 1418266 | A2 * | 5/2004 |

* cited by examiner

*Primary Examiner* — Joseph L Perrin
(74) *Attorney, Agent, or Firm* — James E. Howard; Andre Pallapies

(57) ABSTRACT

A door hook for a door assembly of a household appliance, wherein the household appliance includes a housing having an opening for accessing an interior of the housing, a tub disposed inside the housing, the tub having a rotating drum therein for receiving laundry through the opening, the door assembly having a see-through portion for viewing into the tub, the door assembly being pivotably coupled to the housing and movable between an open position for accessing the opening of the housing and a closed position for closing the opening of the housing, the door hook including a base plate having a front face and a rear face, a striker extending from the front face of the base plate, and a locating feature extending from the rear face of the base plate.

26 Claims, 20 Drawing Sheets

DOOR HOOK FOR A HOUSEHOLD APPLIANCE DOOR

CROSS-REFERENCES TO RELATED APPLICATIONS

This application is related to applicant's U.S. applications, which are filed concurrently herewith, titled "DOOR BOWL FOR A HOUSEHOLD APPLIANCE DOOR", Ser. No. 12/533,038; "DOOR HINGE FOR A HOUSEHOLD APPLIANCE DOOR", Ser. No. 12/512,343; "DOOR FRAME FOR A HOUSEHOLD APPLIANCE DOOR", Ser. No. 12/512,333; "OVERMOLD SEAL AND RAMP FOR A HOUSEHOLD APPLIANCE DOOR", Ser. No. 12/512,325; "INNER RING HAVING A FUNNEL ELEMENT FOR A HOUSEHOLD APPLIANCE DOOR", Ser. No. 12/512,314; and "FRONT RING FOR A HOUSEHOLD APPLIANCE DOOR", Ser. No. 12/533,034, each of which is incorporated herein by reference in its entirety.

FIELD OF THE INVENTION

The present invention is directed toward a household appliance, and more particularly, a door of a household appliance having a see-through portion, and more particularly to a door hook for a door frame of a household appliance.

BACKGROUND OF THE INVENTION

Household appliances, such as clothes washers and dryers, generally include a door that covers an opening for accessing the interior of the appliance. Such clothes washers or dryers commonly include a housing, a rotating drum disposed within the housing, and a driver device for driving the rotating drum. In operation, the door of the appliance is opened and clothes or laundry are inserted into the washer or dryer through the opening and placed in the rotating drum and the door is then closed.

Front-load clothes washers and dryers, which have a door positioned on the front of the appliance, have become increasingly popular in recent years for household use. Such front-load washers and dryers commonly include glass or see-through portions in the door to allow an operator to monitor the laundry while it is in the rotating drum.

The door commonly includes a door hook for engaging a latch on the housing of the washing to secure the door in the clothes position, for example, to prevent opening and leakage of washing liquid onto the floor during operation. The position of the door hook on the door frame can affect the operation and alignment of the door hook with the latch on the washer. As the door is moved into the closed position, even the slightest of variations in the location of the door hook with respect to the door frame can affect the alignment and interaction of the door hook and latch. The ease with which the washer door can be opened or closed can be greatly affected. In some cases, the misalignment of the door hook can prevent the washer door from being latched properly with the housing of the washer.

SUMMARY OF THE INVENTION

These problems and others are addressed by the present invention, a first exemplary embodiment of which comprises a door hook for a door assembly of a household appliance, wherein the household appliance includes a housing having an opening for accessing an interior of the housing, a tub disposed inside the housing, the tub having a rotating drum therein for receiving laundry through the opening, the door assembly having a see-through portion for viewing into the tub, the door assembly being pivotably coupled to the housing and movable between an open position for accessing the opening of the housing and a closed position for closing the opening of the housing, the door hook comprising a base plate having a front face and a rear face, a striker extending from the front face of the base plate, and a locating feature extending from the rear face of the base plate.

Another exemplary embodiment of the invention comprises a household appliance comprising a housing having an opening for accessing an interior of the housing, a tub disposed inside the housing, the tub having a rotating drum therein for receiving laundry through the opening, and a door assembly having a see-through portion for viewing into the tub, the door assembly being pivotably coupled to the housing and movable between an open position for accessing the opening of the housing and a closed position for closing the opening of the housing, wherein the door assembly includes a door frame including a front face having an outside edge and an inside edge, wherein the inside edge defines an opening in the front face that substantially corresponds to a shape of the opening of the housing, a rear face on an opposite side of the door frame from the front face, and a door hook receptacle on the rear face, and a door hook secured to the door hook receptacle, wherein the door hook includes a base plate having a front face and a rear face, a striker extending from the front face of the base plate, and a locating feature extending from the rear face of the base plate.

In this manner, the exemplary embodiments can provide a door hook that can be easily installed without tools (i.e., a tool-less attachment). The position and alignment of the door hook can be provided easily, thereby ensuring a proper alignment of the door hook on the door frame, and thus, a proper alignment with the latch on the housing of the washer. Moreover, the position and alignment of the door hook in the receptacle of the door frame can be fixed prior to inserting a fastener to secure the door hook to the door frame, thereby further ensuring the proper alignment of the door hook.

Other features and advantages of the present invention will become apparent to those skilled in the art upon review of the following detailed description and drawings.

BRIEF DESCRIPTION OF THE DRAWINGS

These and other exemplary embodiments and features of embodiments of the present invention will be better understood after a reading of the following detailed description, together with the attached drawings, wherein.

DETAILED DESCRIPTION

Figure 1:
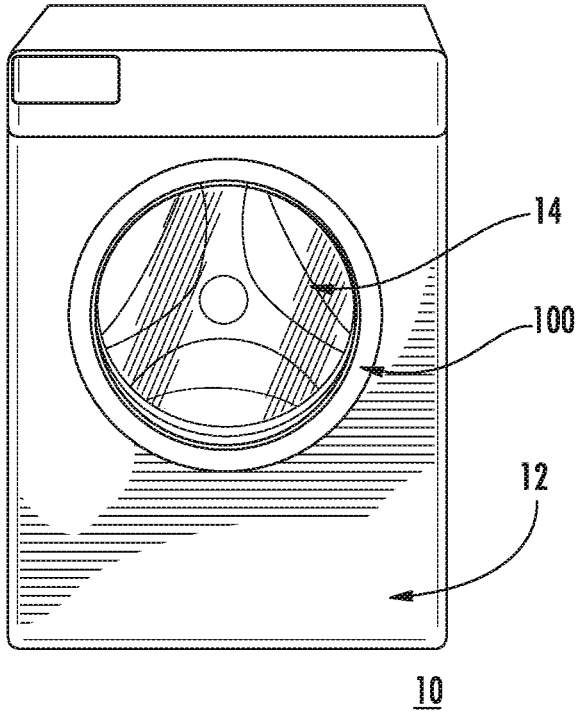
FIG. 1 illustrates a front view of a household appliance, according to an embodiment of the present invention.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Referring now to the drawings, FIGS. 1-7L illustrate exemplary embodiments of a household appliance.

FIG. 1 illustrates a household appliance 10, for example, a washer, having a housing 12 and a door 100 connected to the housing 12. The door 100 is mounted with a hinge to pivot with respect to the housing 12 between an open condition and a closed condition. FIG. 1 shows the door 100 in the closed condition. A rotating drum (not illustrated) and a drive device (not illustrated) for driving the rotating drum are disposed within the housing 12. The rotating drum receives clothes or laundry items for washing the items. FIG. 1 illustrates the door 100 on a horizontal axis washer 10.

The washer 10 can include an opening for accessing the rotating drum in the interior of the housing 12. The housing 12 of the washer 10 can have a hinge mounting surface configured to receive a hinge for pivoting the door 100 with respect to the washer 10. The hinge and door 100 will be described in more detail below. The hinge mounting surface can be located along the perimeter of the opening. The housing 12 can include a support surface or stamping that receives a door hook receptacle. The door hook receptacle can be configured to engage a door hook of the door 100 for retaining the door 100 in a closed position.

Figure 2A:
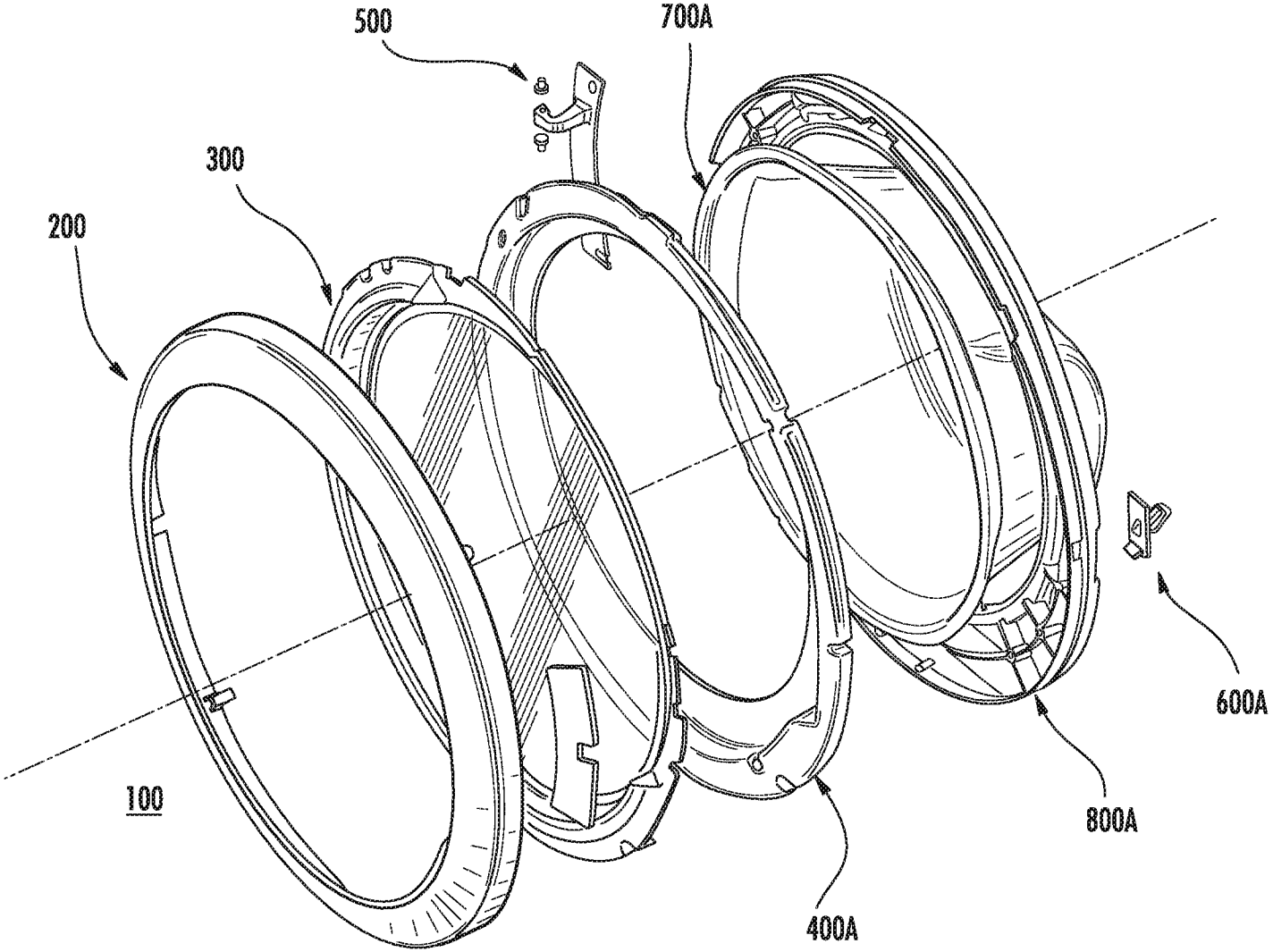
FIG. 2A illustrates an exploded, front perspective view of the door of FIG. 1.
Figure 2B:
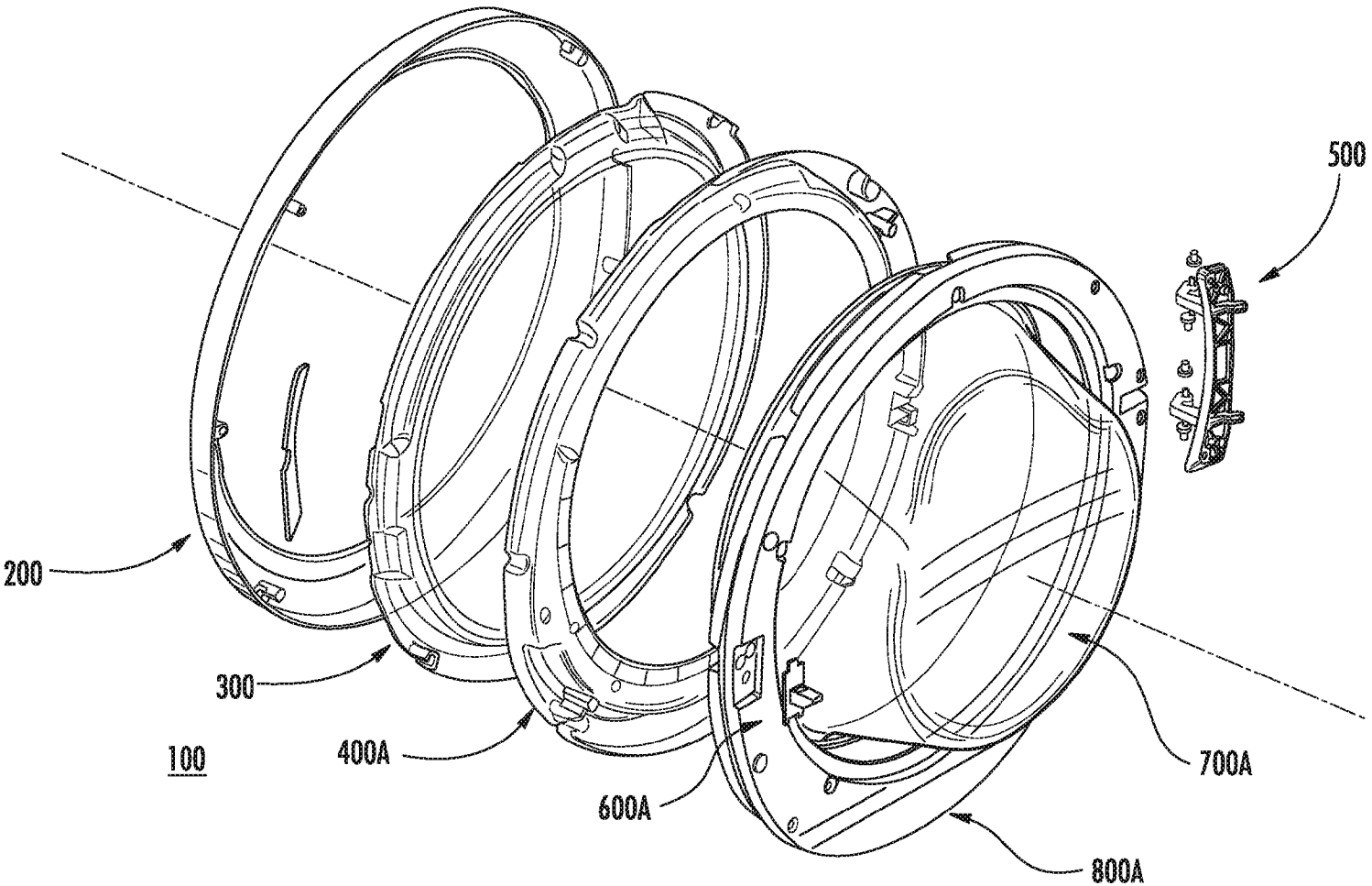
FIG. 2B illustrates an exploded, rear perspective view of the door of FIG. 1.

FIGS. 2A and 2B illustrate exploded assembly views of an exemplary arrangement of a washer door 100 of FIG. 1. The door 100 includes a front ring 200, a plastic cover panel 300, an inner ring 400A, a door hinge 500, a door hook or latch 600A, a glass bowl 700A, and a door frame 800A, among other features. The features of each of these components will be described in more detail below.

Figure 2E:
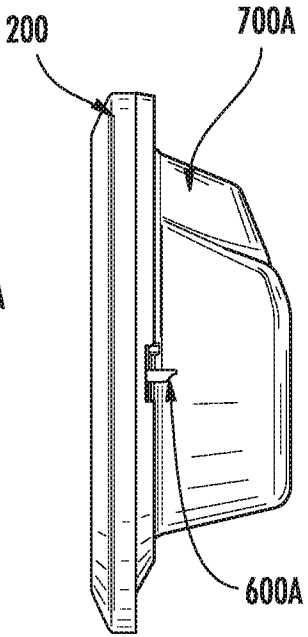
FIG. 2E illustrates a side view of the assembled door of FIG. 1.
Figure 2D:
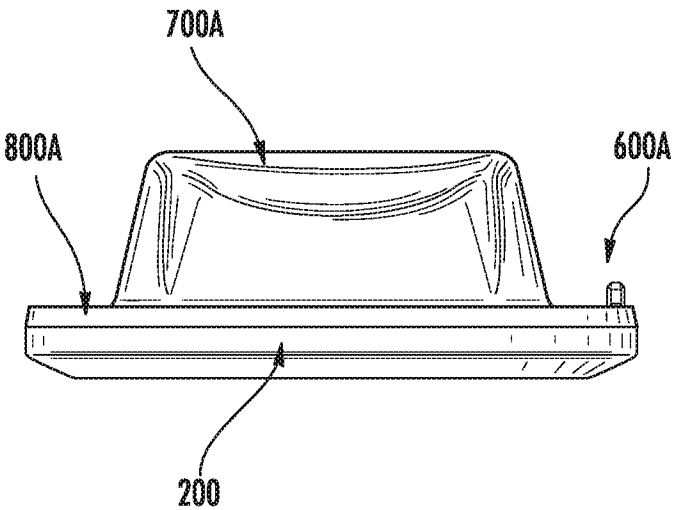
FIG. 2D illustrates a top down view of the assembled door of FIG. 1.
Figure 2C:
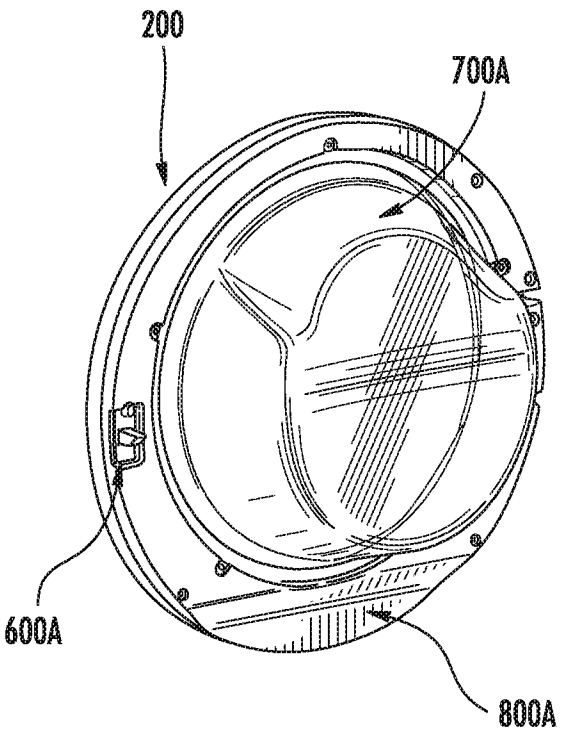
FIG. 2C illustrates a rear perspective view of the assembled door of FIG. 1.

FIGS. 2C-2E illustrate an assembled washer door 100 of FIG. 1 having a front ring 200, a door frame 800A, a glass bowl 700A, and a door hook 600A.

Figure 3B:
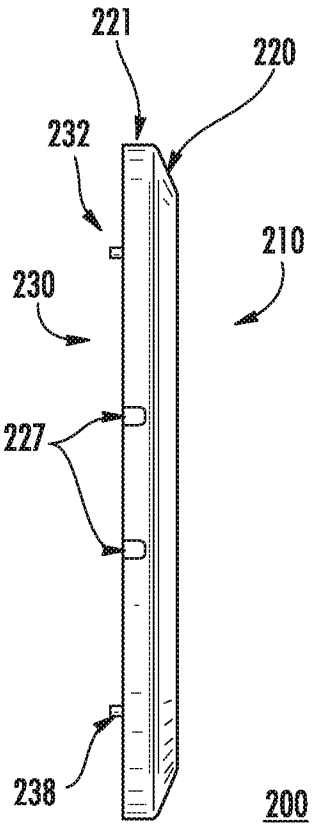
FIG. 3B illustrates a side view of a front ring of a door according to an embodiment of the invention.
Figure 3A:
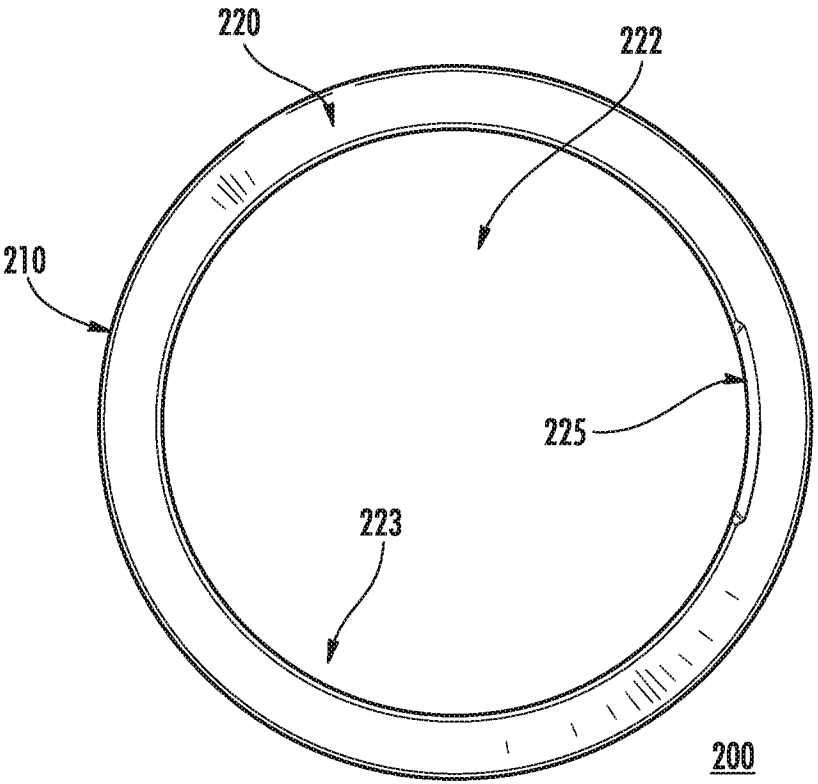
FIG. 3A illustrates a front view of a front ring of a door according to an embodiment of the invention.
Figure 3C:
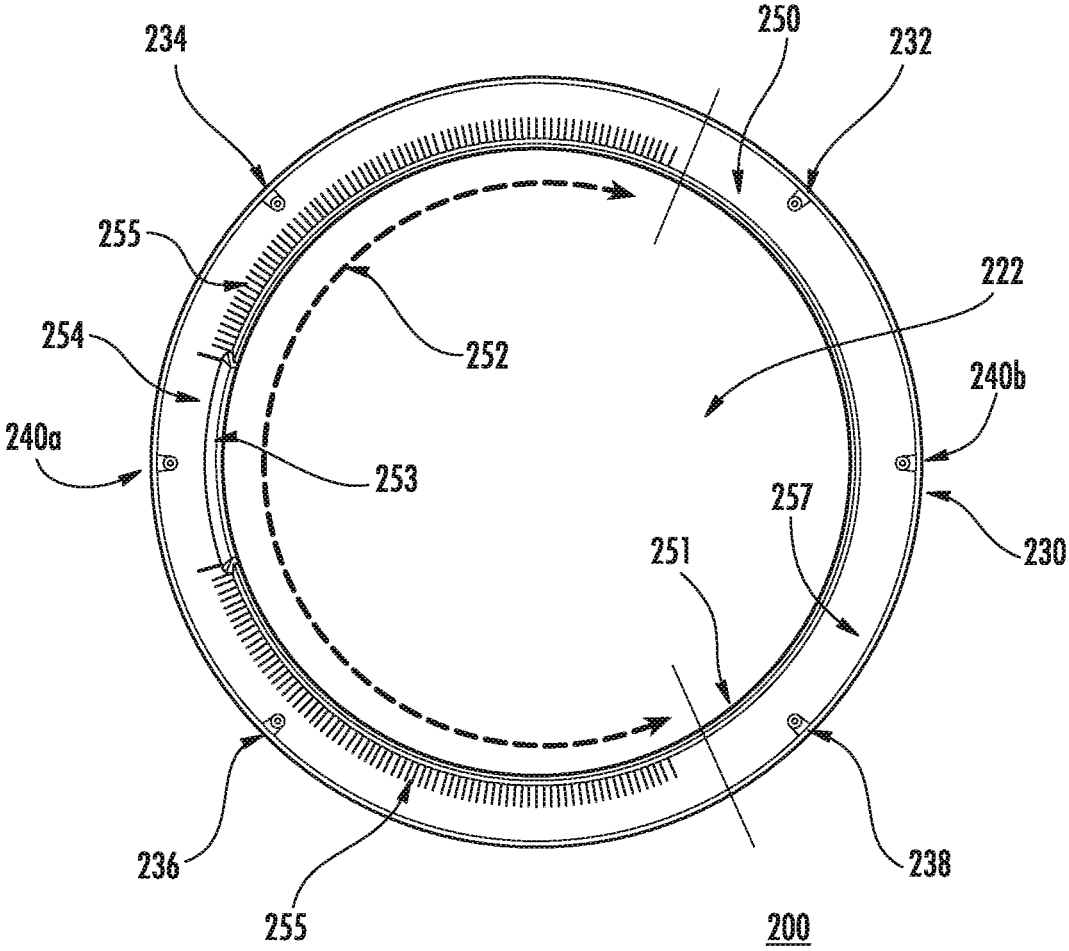
FIG. 3C illustrates a rear view of a front ring of a door according to an embodiment of the invention.

With reference to FIGS. 3A-3C, exemplary embodiments of a front ring 200 will now be described.

As shown in FIGS. 3A-3C, an exemplary embodiment of the front ring 200 can have a substantially circular shape when viewed from the front side 210. However, other shapes are contemplated within the spirit and scope of the invention.

In an exemplary embodiment, the front ring 200 can be configured to correspond to both the frame 400A of the washer 10 and the frame of a dryer (not shown). That is, the front ring 200 can be configured to be universal or common to both a washer door 100 and a dryer door 130. The front ring 200 can include an opening 222 that corresponds to the see-through portion 14 of the washer door 100 and the dryer door 130. The opening 222 can have, for example, a circular or oval shape, as illustrated. However, in other exemplary embodiments, the opening can have other shapes. The opening 222 can be centered (e.g., concentric) within the front ring 200, or off-center. For example, in the exemplary embodiment illustrated, a center of the opening 222 is offset from, or above, a center of the front ring 200 such that a distance from the opening 222 to the outside edge of the front ring is greater at the bottom portion of the washer door 100 or the dryer door 130 than at the top portion of the washer door 100 or the dryer door 130.

The front ring 200 can be configured to work in conjunction with, or cooperate with, the plastic cover panel 300, which in turn can be configured to work in conjunction with, or cooperate with, the inner ring 400A. The plastic cover panel 300 and the inner ring 400A, as well as the relationship between these features and the front ring 200, will be described in more detail below.

As shown in FIGS. 3A and 3B, the front side 210 of the front ring 200 can include a face or surface 220, such as a beveled surface. The surface 220 can be, for example, colored, textured, smooth, or wrapped in metal, such as stainless steel, to provide a desired cosmetic appearance for the door assembly. The surface 220 can include a tapered edge 223 extending around a perimeter of the opening 222 and forming a lip 251 on the rear side of the front ring 220, as shown in FIG. 3C. The surface 220 also can include a tapered or beveled edge portion 225 corresponding to a location of a handle 254, for example, for visually or physically identifying the optimum handle location for opening and closing the door. The front ring 200 can include a side surface 221, extending in a direction of an axis of the opening 222. The side surface 221 can include hinge clearance features 227.

The rear side 230 can include a recessed rear face 250. The recessed rear face 250 can be bordered by an inner wall 257 of the side surface 221 and the lip 251, extending around the perimeter of the opening 222. The inner wall 257 can include a beveled or tapered surface 253 corresponding to the tapered or beveled edge portion 225.

The rear face 250 can include a handle portion 252 extending at least a portion of the way around the perimeter of the opening 222 of the front ring 200. As shown in FIGS. 3B, and 3C, the handle portion 252 can be symmetrical with respect to the front ring 200, and more particularly, with respect to the screw points 240*a*, 240*b*, such that the front ring 200 can be universally used for either a right hand door or a left hand door. Also, the screw points 232, 234, 236, and 238 can be symmetrical.

In an exemplary embodiment, the handle portion 252 can include a grip portion 254. The grip portion 254 can include gripping means or a gripping feature 255, such as recessed grooves, finger grooves, elevated portions, bumps, or textures, or a separate piece that provides a gripping surface, such as a rubber surface, a textured surface, etc. The handle portion 252 can extend around at least a portion of the rear face 250. The handle portion 252 and/or the gripping feature 255 can be continuous or intermittent along the rear face 250. In this manner, the front ring 200 can be changed from a right-hand configuration to a left-hand configuration, for example for a dryer door 130, by rotating the front ring 200 by 180° in either direction.

The exemplary embodiments provide important advantages in that a user can open and close the door by grasping the front ring 200 at any location along the handle portion 252. The handle portion 252 provides a wide range for a user to grasp the door and apply force to open the door.

Additionally, the handle portion 252 is concealed from view behind the front ring 200. The concealed handle portion 252 provides a smooth exterior appearance that reduces the encroachment of the appliance into the space immediately in front of the appliance. In this manner, the front ring 200 can provide a user-friendly door handle that is less susceptible to dirt, fingerprints, etc. because the handle portion 252 is concealed. The front ring also can improve the aesthetic appearance of the appliance to the user.

The front ring 200 can be configured to work in conjunction with, or cooperate with, the plastic cover 300 and/or the inner ring 400A of the washer. The plastic cover 300 and/or the inner ring 400A can include a corresponding recessed portion or lip that corresponds to the handle portion 252 of the front ring 200 and provides clearance for gripping the handle portion 252 of the front ring 200. The recessed portion or lip of the plastic cover 300 and/or the inner ring 400A can extend at least a portion of the way around the perimeter of the door, and can include one or more indentions corresponding to the handle location(s) 254 of the front ring 200.

As shown in FIG. 3C, the rear side of the front ring 200 can include a plurality of fastener points, such as screw points (e.g., 232, 234, 236, 238, 240*a*, and 240*b*), spaced around the perimeter of the front ring 200 for securing the front ring 200 to other components of the door assembly.

In an exemplary embodiment, the front ring 200 can be secured to the door frame 800A using, for example, a plurality of screws inserted from the rear of the door assembly through corresponding openings or screw points in the door frame 800A, then through clearance features or openings on the plastic cover panel 300 and the inner ring 400A, and into the screw points 232, 234, 236, 238, 240*a*, and 240*b*.

The exemplary embodiments are not limited to assembly using screws. In other exemplary embodiments, these screw points can be other types of connection points, attachments, or receptacles for receiving fasteners such as screws, bolts, plastic fasters, or the like, or for mating with other fasteners.

In an exemplary embodiment, one or more screw points 240*a*, 240*b* can be provided at or near a location corresponding to a location of a door handle 254 to distribute or transfer the force applied at the handle location to the door frame 800A.

Figure 5A:
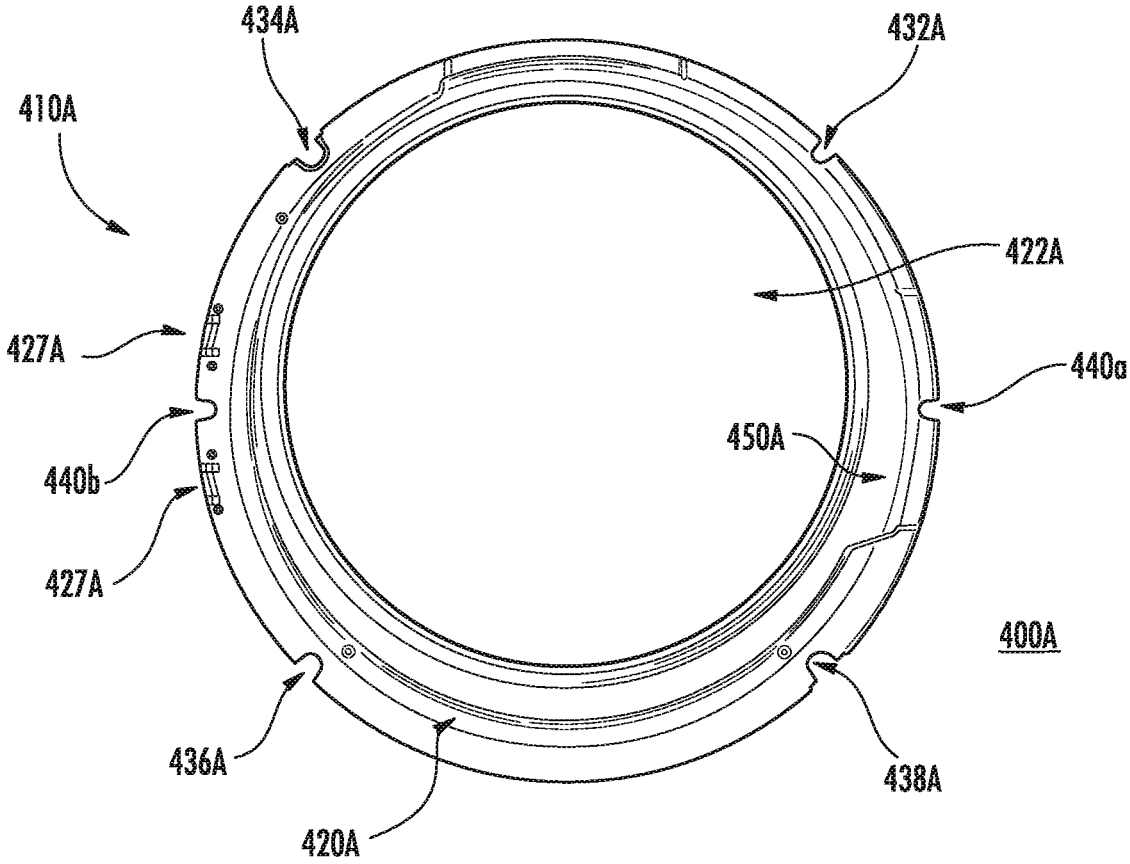
FIG. 5A illustrates a front view of the inner ring of the door of FIGS. 2A, 2B.
Figure 5B:
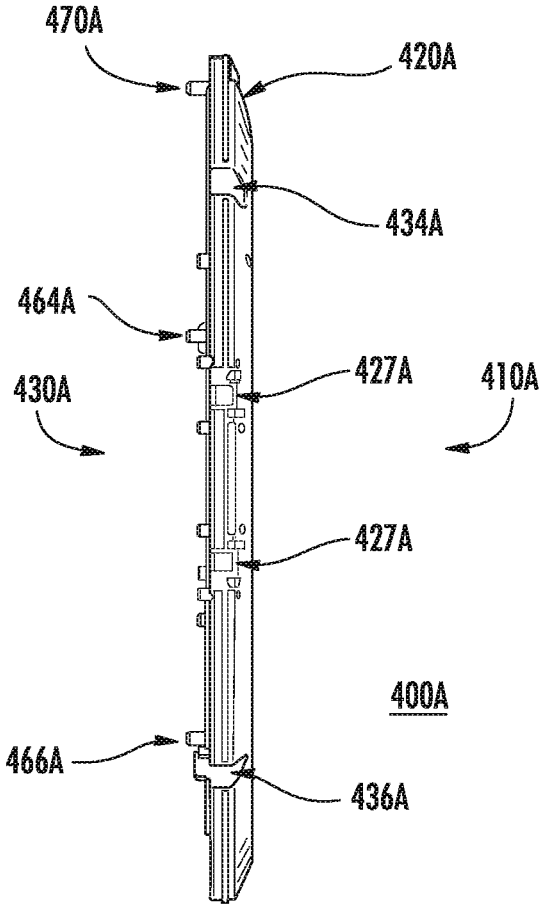
FIG. 5B illustrates a side view of the inner ring of the door of FIGS. 2A, 2B.
Figure 5C:
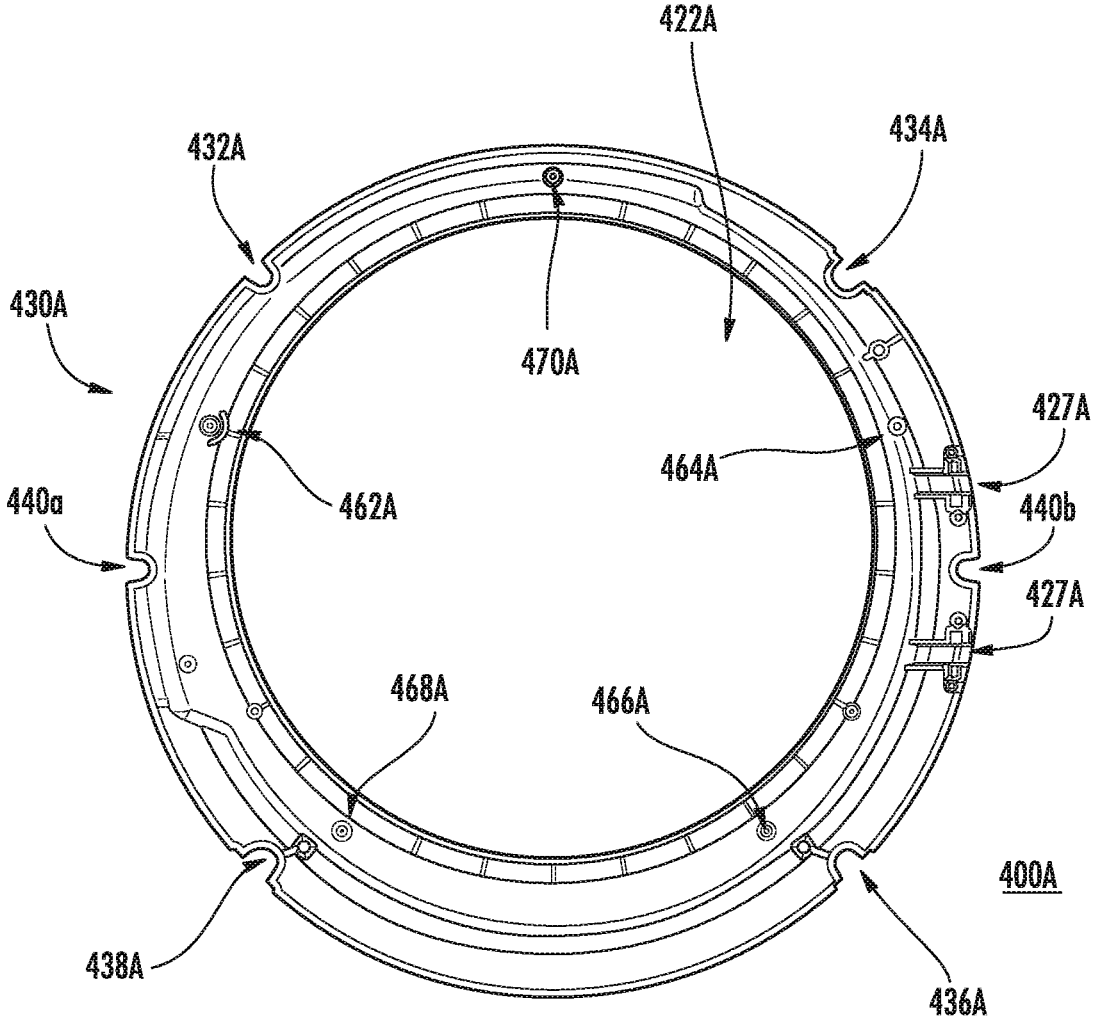
FIG. 5C illustrates a rear view of the inner ring of the door of FIGS. 2A, 2B.

Additionally, the screw points (e.g., 232, 234, 236, 240*a*, and 240*b*) can be configured such that the front ring 200 can only have a single orientation for assembly for a left-hand door and only a single orientation for assembly for a right-hand door, as shown in FIGS. 5B and 5C. For example, in the disclosed exemplary embodiment, the screw points 232, 234, 236, 238, 240*a*, and 240*b* are symmetrically arranged. In this manner, the front ring 200 can only be assembled in two possible orientations; one orientation for a right-hand door and one orientation for a left-hand door, thereby reducing assembly time and ensuring proper assembly. The right-hand door position is oriented 180 degrees from the left-hand door position. The correct orientation of the two possible orientations is easily selected during assembly based on the left-hand or right-hand hinge, since the hinge will obstruct the assembly if the front ring 200 orientation does not correspond to the hinge orientation.

As explained above, the front ring 200 can be universal to both the washer 10 and the dryer 30, thereby reducing manufacturing costs and complexity of the household appliances.

As explained above, the front ring 200 can be coupled to the door frame 800A at each of the screw points (e.g., 232, 234, 236, 238, 240*a*, and 240*b*). More particularly, the front ring 200 can be secured to the door frame 800A using, for example, a plurality of screws inserted from the rear of the door assembly through corresponding openings or screw points in the door frame 800A, then through clearance features or openings on the plastic cover panel 300 and the inner ring 400A, and into the screw points 232, 234, 236, 238, 240*a*, and 240*b*. The screw points (e.g., 232, 234, 236, 238, 240*a*, and 240*b*) can couple the front ring 200 to the door frame 800A. In the illustrated exemplary embodiment, the front ring 200 can secure or press fit the plastic cover panel 300 between the front ring 200 and the inner ring 400A, which can be coupled to the door frame 800A using separate attachment points.

In this manner, the front ring 200 is not necessary for assembly of the primary components of the door, which are needed for functional operation of the door. The front ring 200 can be removed or disassembled from the door frame 800A without affecting the functionality of the washer door 100 or the dryer door 130, respectively. The front ring 200 can be easily and efficiently removed and/or attached to simplify assembly, facilitate repairs, cosmetic changes, etc. without affecting the function of the washer door 100 or the dryer door 130. Moreover, in the illustrated exemplary embodiments, the front ring 200 can be easily and efficiently removed and/or attached to facilitate repair or replacement of the plastic cover panel 300, without affecting the function of the washer door 100 or the dryer door 130.

As explained above, the screw points 232, 234, 236, 238, 240*a*, and 240*b* support the front ring 200, or the front ring 200 and the plastic cover panel 300, and therefore, are not subjected to a large amount of forces. In contrast, the door frame 800A and the inner ring 400A are subjected to the weight of the glass bowl, etc.

In this manner, as shown in FIG. 3C, the screw points 232, 234, 236, 238, 240*a*, and 240*b* can be located at or near the outer edge of the front ring 200, which may be of lesser strength than an inner portion of the front ring 200. The corresponding screw points on the door frame 800A also can be located at or near the outer edge of the door frame 800A.

By locating the screw points for securing the front ring to the door frame 800A at or near the edge of the door frame, the screw points for assembling the other components of the door, which may be subject to much higher forces, can be located in a more robust or higher strength portion of the door frame 800A, such as at or near a center portion between the outer edge and the inner edge of the door frame 800A.

Moreover, the accessibility of the screw points may be improved, thereby providing easy access to these screws for easily and efficiently attaching the front ring 200 to the door assembly after the door has been assembled, or after the assembled door has been installed on the appliance housing. Thus, the front ring 200 and/or the plastic cover panel 300 can be repaired or replaced with little effort.

The embodiments are not limited to the disclosed exemplary embodiments. In other exemplary embodiments, the front ring 200 can secure one or more of the plastic cover 300 to the door frame 800A.

Figure 4A:
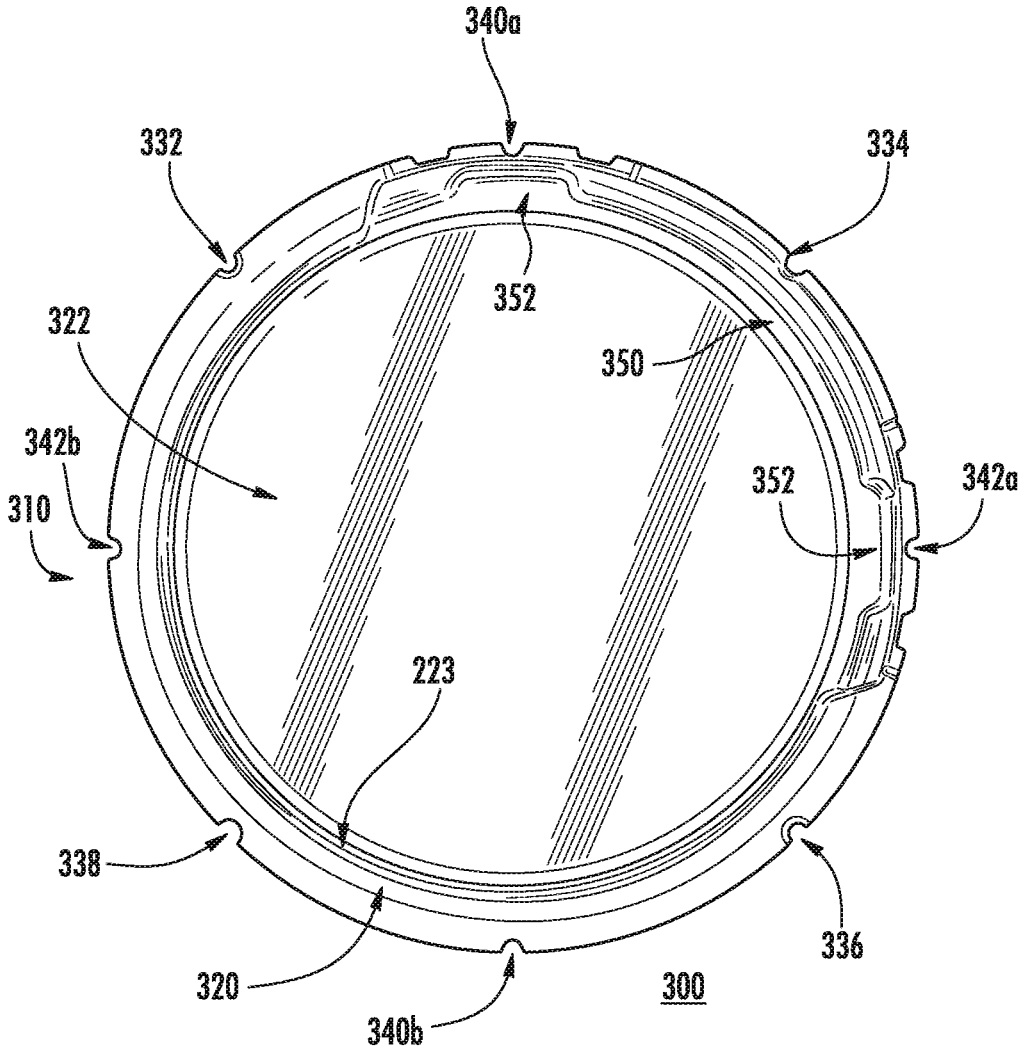
FIG. 4A illustrates a front view of a plastic panel of a door according to an embodiment of the invention.
Figure 4B:
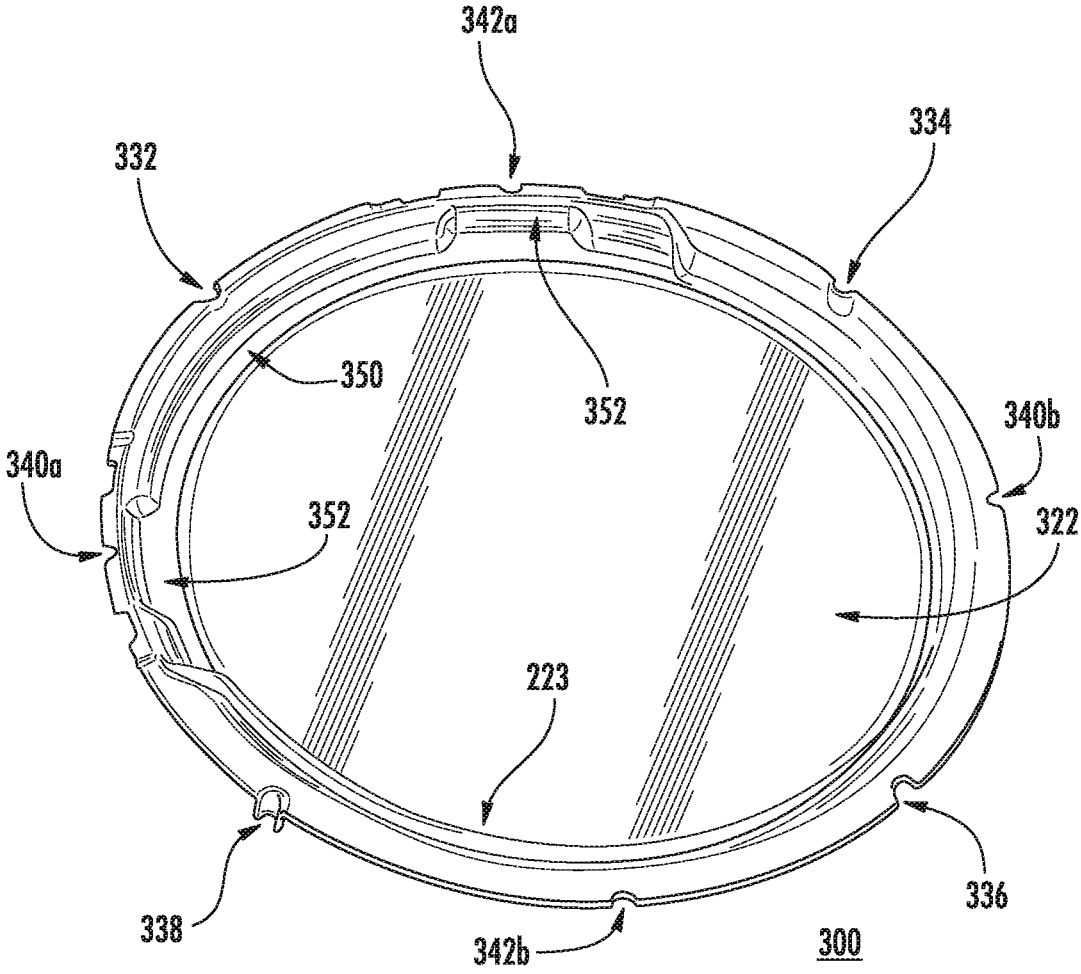
FIG. 4B illustrates a front perspective view of a plastic panel of a door according to an embodiment of the invention.
Figure 4C:
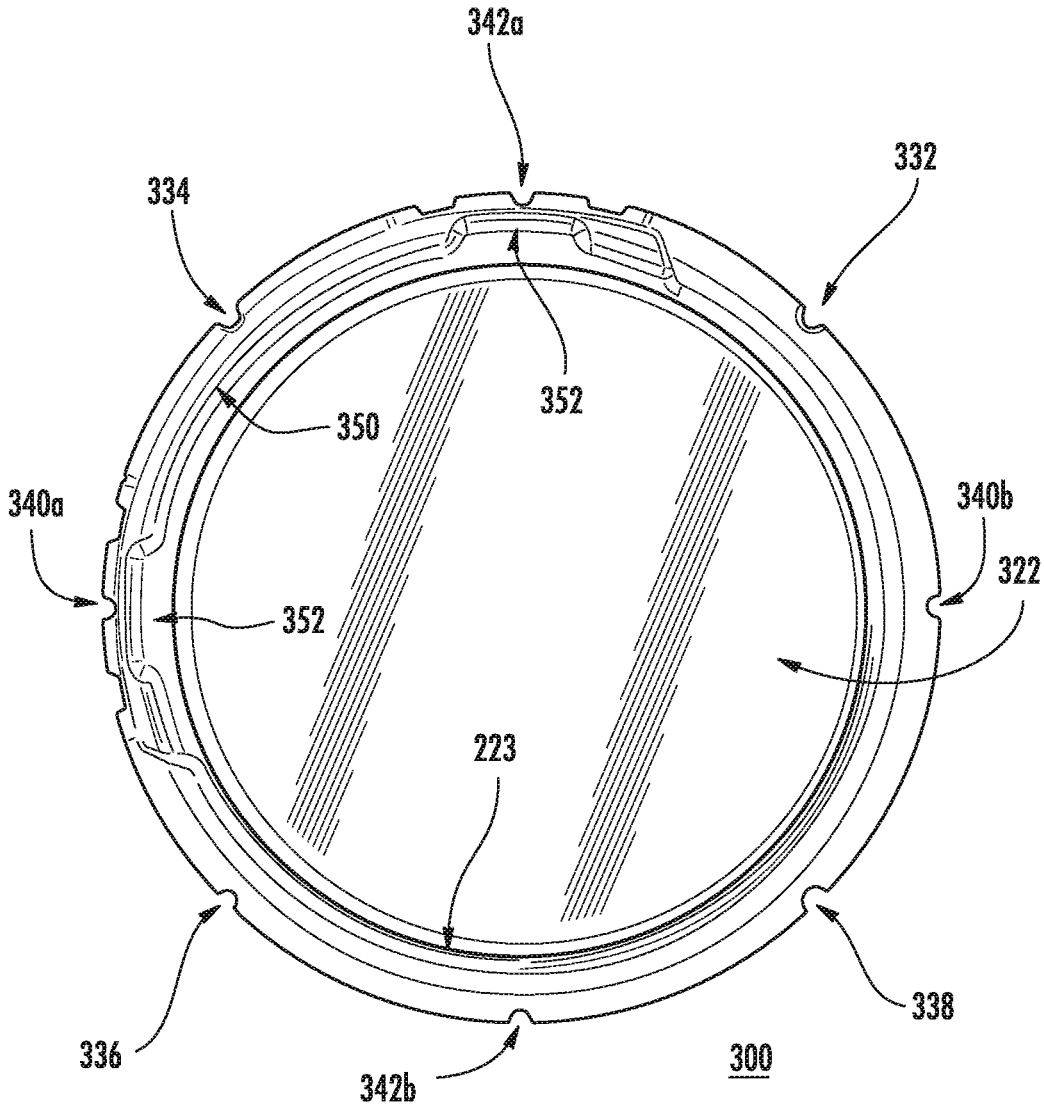
FIG. 4C illustrates a rear view of a plastic panel of a door according to an embodiment of the invention.

With reference to FIGS. 4A-4C, exemplary embodiments of a plastic cover panel 300 will now be described.

As shown in FIGS. 4A-4C, an exemplary embodiment of the plastic cover panel 300 can have a substantially circular shape when viewed from the front side 310. However, other shapes are contemplated within the spirit and scope of the invention.

In an exemplary embodiment, the plastic cover panel 300 can be configured to be universal or common to both a washer door 100 and a dryer door 130. The plastic cover panel 300 can include a see-through portion 322 that corresponds to the see-through portion 14 of the washer door 100 and the dryer door 130. In an exemplary embodiment, the plastic cover panel 300 is formed from a substantially transparent or translucent plastic.

FIGS. 4A and 4B illustrate an exemplary embodiment of the front side 310 of the plastic cover panel 300. FIG. 4C illustrates the plastic cover panel 300 from the rear side 330.

The plastic cover panel 300 can be configured to work in conjunction with, or cooperate with, the front ring 200 and the inner ring 400A. The front side 310 can include a ring portion 320 extending around a perimeter of the see-through portion 322. In an exemplary embodiment, both the ring portion 320 and the see-through portion 322 are formed from a substantially transparent or translucent plastic.

The see-through portion 322 can have, for example, a circular or oval shape, as exemplarily illustrated. However, in other exemplary embodiments, the opening can have other shapes, such as a half-circle, half-oval, square, or rectangle shape, among other shapes. A center point of the see-through portion 222 can be concentric with a center point of the ring portion 320, or disposed off-center from the center point of the ring portion 320. For example, in the exemplary embodiment illustrated, a center of the see-through portion 322 can be offset from, or above, a center of the ring portion 320 such that a thickness of the ring portion 320 (i.e., a distance from the perimeter of the see-through portion 322 to the outside edge of the ring portion 320) is greater at the bottom portion of the washer door 100 or the dryer door 130 than at the top portion of the washer door 100 or the dryer door 130.

The ring portion 320 can include a recessed portion or lip 350 that corresponds to the grip or handle portion 252 of the front ring 200 and provides clearance for gripping the grip or handle portion 252 of the front ring 200. The recessed portion or lip 350 can extend at least a portion of the way around the perimeter of the ring portion 320 of the plastic cover panel 300. In an exemplary embodiment, the recessed portion or lip 350 can include one or more indentions 352 corresponding to one or more handle locations of the front ring 200.

As shown in FIGS. 4A and 4B, the plastic cover panel 300 can include a plurality of fastener points or pockets (e.g., locating features and/or clearance features) 332, 334, 336, and 338, that correspond to the locations of the screw points 232, 234, 236, and 238 of the front ring 200. The locating and/or clearance features 332, 334, 336, and 338 can correspond to similar features in the inner ring 400A, as described in more detail below.

The locating and/or clearance features 332, 334, 336, and 338 can include, for example, an opening, notch, clearance feature, locating feature, protrusion, screw boss, partial screw boss, or the like (e.g., 362, 364, 366, 368) that engages the corresponding feature of the inner ring 400A for aligning and positioning the plastic cover panel 300 in an assembled position. The locating and/or clearance features 332, 334, 336, and 338 can provide clearance for fasteners extending from the door frame 800A through clearance features of the inner ring 400A and into the screw points 232, 234, 236, and 238 of the front ring 200.

In an exemplary embodiment, the plastic cover panel 300 can include one or more locating and/or clearance features 340*a*, 340*b*, 342*a*, 342*b* that correspond to the location(s) of the screw points 240*a*, 240*b* of the front ring 200, which are configured to correspond to a location of a door handle to distribute or transfer the force applied at the handle location to the door frame 800A.

The locating and/or clearance features 340*a*, 340*b*, 342*a*, 342*b* can be symmetrical with respect to one of the locating and/or clearance features (e.g., 334) such that the plastic cover panel 300 can be universally used for either a right hand door or a left hand door.

The locating and/or clearance features 332, 334, 336, 338, 340*a*, 340*b*, 342*a*, 342*b* can be configured such that the plastic cover panel 300 can only have a single orientation for assembly for a heft-hand door and only a single orientation for assembly for a right-hand door. In an exemplary embodiment, the plastic cover panel 300 can be changed from a right-hand configuration to a left-hand configuration, for example for a dryer door 130, by rotating the plastic cover panel 300 by 90°. Depending on the position of the plastic cover panel 300 in the right-hand position or the left-hand position, one of the locating and clearance features 340*a*, 340*b* or 342*a*, 342*b* can correspond to the location of the screw points 240*a*, 240*b* of the front ring 200, which can help to assure that the plastic cover panel 300 is correctly positioned for assembly.

In another exemplary embodiment, the size of one or more of the locating and/or clearance features 332, 334, 336, 338, 340*a*, 340*b*, 342*a*, 342*b* can be different from a size of the other clearance features such that the plastic cover panel 300 can only have a single orientation for assembly with the inner ring 400A. Also, the inner shape of the cover glass can have a shape that matches or corresponds to a shape of the opening 222 of the inner ring.

In yet another exemplary embodiment, one or more of the locating and/or clearance features 332, 334, 336, 338, 340*a*, 340*b*, 342*a*, 342*b* can include an extension or protrusion configured that engages the corresponding locating and/or clearance feature of the inner ring 400A. In the illustrated exemplary embodiment, the locating and/or clearance features 334 and 338 have a protrusion. However, the embodiments are not limited to the illustrated exemplary embodiment and other configurations are possible within the spirit and scope of the invention.

As explained above, the plastic cover panel 300 can be universal to both the washer 10 and dryer 30 such that only a single station on the assembly line is needed for installing the front ring for both the washer 10 and dryer 30.

In an exemplary embodiment, the plastic cover panel 300 is disposed between the front ring 200 and the inner ring 400A when the washer door 100 or dryer door 130 is assembled. By securing the front ring 200 to the door frame 800A, the plastic cover panel 300 is secured (e.g., press fit) between the front ring 200 and the inner ring 400A. In these exemplary embodiments, the plastic cover panel 300 is not necessary for operation of the door assembly. The plastic cover panel 300 can be removed or disassembled from the door frame 800A by removing the front ring 200 without affecting the operation of the washer door 100 or the dryer door 130. According to these exemplary embodiments, the plastic cover panel 300 can be easily and efficiently removed and/or attached to facilitate repairs, cosmetic changes, etc. without affecting the function of the washer door 100 or the dryer door 130.

With reference to FIGS. 5A-5C, exemplary embodiments of an inner ring 400A, for example for a washer 10, will now be described.

As shown in FIGS. 5A-5C, an exemplary embodiment of the inner ring 400A can have a substantially circular shape when viewed from the front. However, other shapes are contemplated within the spirit and scope of the invention.

In an exemplary embodiment, the inner ring 400A can be configured to correspond to the front ring 200 and plastic cover or panel 300 of the washer 10 or dryer 30. In an exemplary embodiment, the inner ring 400A can be configured to have features that are particular to a washer door 100.

The inner ring 400A can include an opening 422A that corresponds to the see-through portion 14 of the washer door 100. The opening 422A can have, for example, a circular or oval shape, as illustrated. However, in other exemplary embodiments, the opening can have other shapes.

The opening 422A can be centered (e.g., concentric) within the inner ring 400A, or off-center. For example, in the exemplary embodiment illustrated, a center of the opening 422A is offset from, or above, a center of the inner ring 400A such that a distance from the opening 422A to the outside edge of the inner ring 400A is greater at the bottom portion of the washer door 100 than at the top portion of the washer door 100.

The door frame can be configured to work in conjunction with, or cooperate with, the plastic cover panel 300, which in turn can be configured to work in conjunction with, or cooperate with, the front ring 200.

FIG. 5A illustrates an exemplary embodiment of the front side 410A of the inner ring 400A. The inner ring 400A can include a ring portion 420A. The ring portion 420A can include a recessed portion or lip 450A that corresponds to the grip or handle portion 252 of the front ring 200 and the recessed portion or lip 350 of the plastic cover panel 300, which provide clearance for gripping the grip or handle portion 252 of the front ring 200. The recessed portion or lip 450A can extend at least a portion of the way around the perimeter of the ring portion 420A of the inner ring 400A.

As shown in FIGS. 5A and 5B, the inner ring 400A can include a plurality of locating and/or clearance features 432A, 434A, 436A, and 438A that correspond to the locations of locating and/or clearance features 332, 334, 336, and 338 of the plastic cover panel 300 and the screw points 232, 234, 236, and 238 of the front ring 200. The locating and/or clearance features 432A, 434A, 436A, and 438A can correspond to through holes and/or locating features 832A, 834A, 836A, and 838A of the door frame 800A, as described in more detail below.

The locating and/or clearance features 432A, 434A, 436A, and 438A can include, for example, an opening, notch, clearance feature, locating feature, protrusion, screw boss, partial screw boss, or the like that engages the corresponding feature of the door frame 800A for aligning and positioning the inner ring 400A in an assembled position. The locating and/or clearance features 432A, 434A, 436A, and 438A can provide clearance for fasteners extending from the door frame 800A such that the fasteners can extend through corresponding clearance features 332, 334, 336, and 338 of the plastic cover panel 300 and into the screw points 232, 234, 236, and 238 of the front ring 200.

In an exemplary embodiment, the inner ring 400A can include one or more locating and/or clearance features 440*a*, 440*b* that correspond to the location of clearance features 340*a*, 340*b* or 342*a*, 342*b* of the plastic cover panel 300 and the screw points 240*a*, 240*b* of the front ring 200. These features are configured to correspond to a location of a door handle or grab handle to distribute or transfer the force applied at the handle location to the door frame 800A.

The locating and/or clearance features 432A, 434A, 436A, and 438A can be configured such that the inner ring 400A can only have a single orientation for assembly. For example, one or more of the locating and/or clearance features 432A, 434A, 436A, and 438A can have a size different from a size of the other clearance features, such that only a single orientation is possible. In this exemplary embodiment, the size of each clearance feature can correspond to a size of the locating and/or clearance features 332, 334, 336, 338, 340*a*, 340*b*, 342*a*, 342*b* of the front ring 200 and plastic cover 300. In other exemplary embodiments, the locating and/or clearance features can have a different shape, or a different size and shape, among other things.

In the illustrated exemplary embodiment, the locating and/or clearance features 434A and 438A can be larger than the other clearance features to accommodate both the locating features of the front ring 200 and the locating and/or clearance features 334 and 338 of the plastic cover 300, which can include an extension. The embodiments are not limited to the illustrated exemplary embodiment and other configurations are possible within the spirit and scope of the invention.

The inner ring 400A can include hinge pockets 427A for receiving a hinge 500, which will be described in more detail below. In an exemplary embodiment of the washer door 10, the hinge 500 can be secured or captured between the inner ring 400A and the washer frame 800A. In this manner, the inner ring 400A and the washer frame 800A act as a single part and the forces on the hinge 500 are transferred over both the inner ring 400A and the washer frame 800A.

The washer door 100 may not be configured to be disassembled by the end user. Hence, the inner ring 400A and the door frame 800A can be configured to have the hinge pockets 427A and 827A on a single side of the door, such that the washer door 100 can be configured to swing in only a single direction.

In an exemplary embodiment, the hinge pockets 427A can be 180° hinge pockets formed between the inner ring 400A and the washer frame 800A. The corresponding features of the inner ring 400A and the washer frame 800A can be conical shaped features that engage one inside the other.

With reference to FIG. 5B, the rear side 430A will now be described.

The inner ring 400A can include a plurality of fastener points, such as screw points 462A, 464A, 466A, 468A, and 470A, which correspond to the fastener points, e.g., screw points 862A, 864A, 866A, 868A, and 870A, of the door frame 800A, which will be described in more detail below. In this manner, the inner ring 400A and the door frame 800A can act as a single component to secure or capture the glass bowl 700A there between.

In an exemplary embodiment, the corresponding screw points of the inner ring 400A and the washer frame 800A can be conical shaped features that engage one inside the other.

In another exemplary embodiment, the screw points 462A, 464A, 466A, 468A, and 470A can be located around a perimeter of the opening 422A of the inner ring 400A. The screw points 462A, 464A, 466A, 468A, and 470A can be located closer to the opening 422A than to the outside edge of the inner ring 400A. In this manner, these screw points can be located proximate the rim of the glass bowl, thereby transferring and distributing the weight of, and the forces acting on, the glass bowl 700A to the inner ring 400A and the door frame 800A. Additionally, the screw points can be located in a more robust portion of the respective inner ring 400A and door frame 800A than the screw points for the front ring 200.

As explained above, the disclosed exemplary embodiments have a plurality of screw points (e.g., 462A, 464A, 466A, 468A, and 470A). However, in other exemplary embodiments, these screw points can be other types of connection points, attachments, or receptacles for receiving fasteners such as screws, bolts, plastic fasters, or the like, or for mating with other fasteners.

The hinge pockets 427A are configured to receiving a hinge 500, which will be described in more detail below. In an exemplary embodiment of the washer door 10, the hinge 500 can be secured between the inner ring 400A and the washer frame 800A.

Figure 6A:
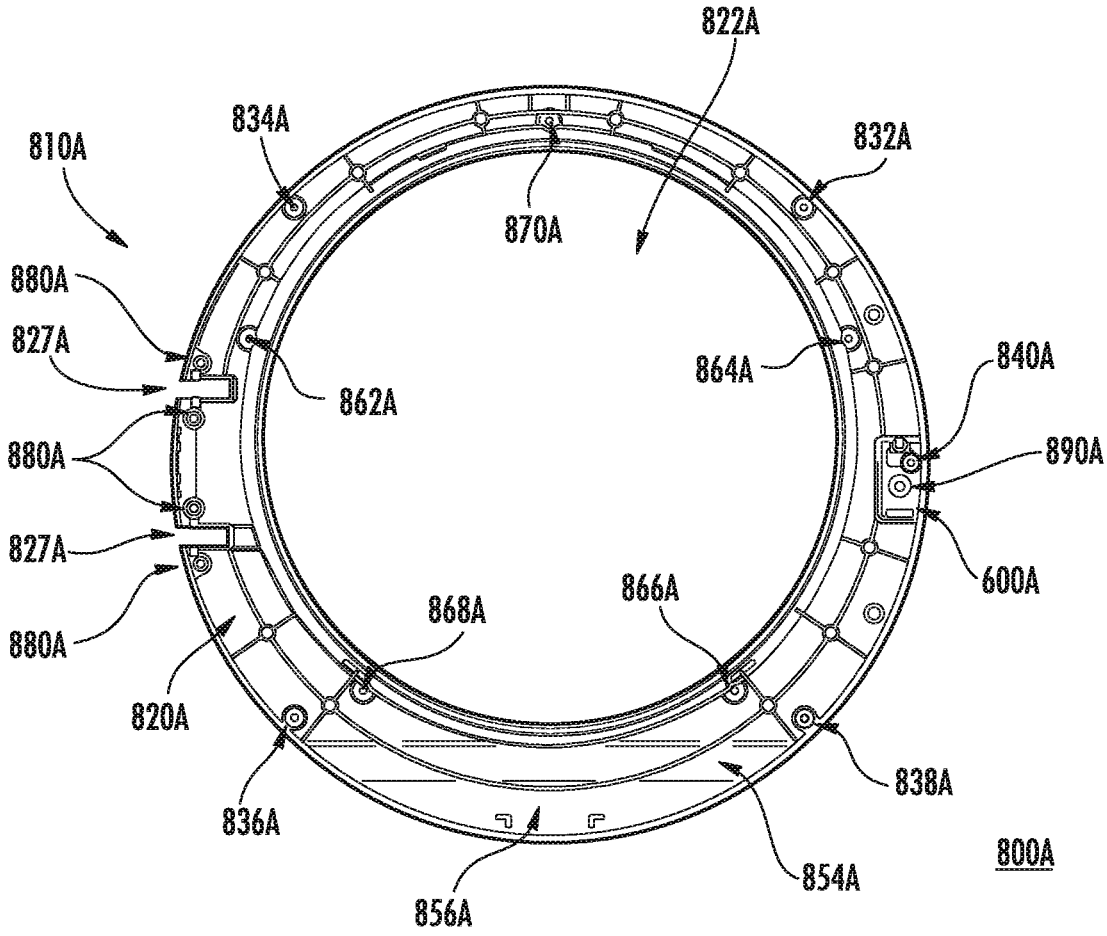
FIG. 6A illustrates a front view of the door frame of the door of FIGS. 2A, 2B.
Figure 6B:
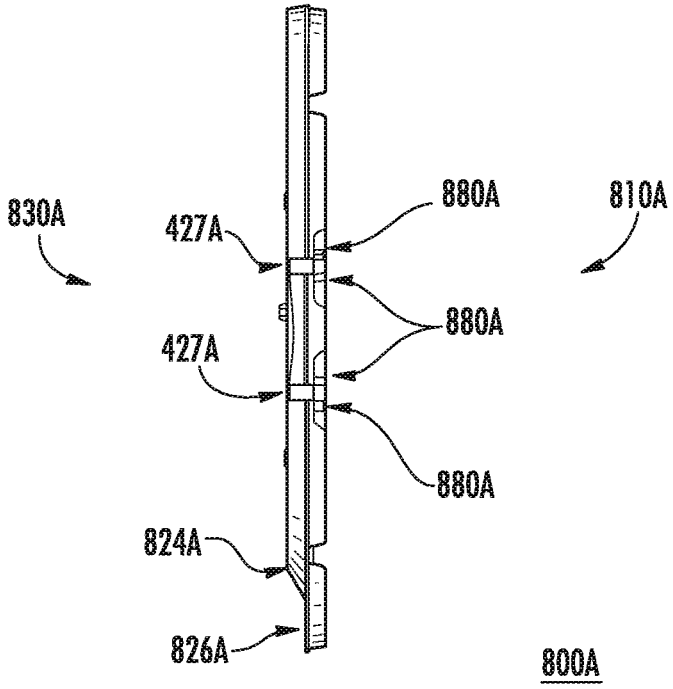
FIG. 6B illustrates a side view of the door frame of the door of FIGS. 2A, 2B.
Figure 6C:
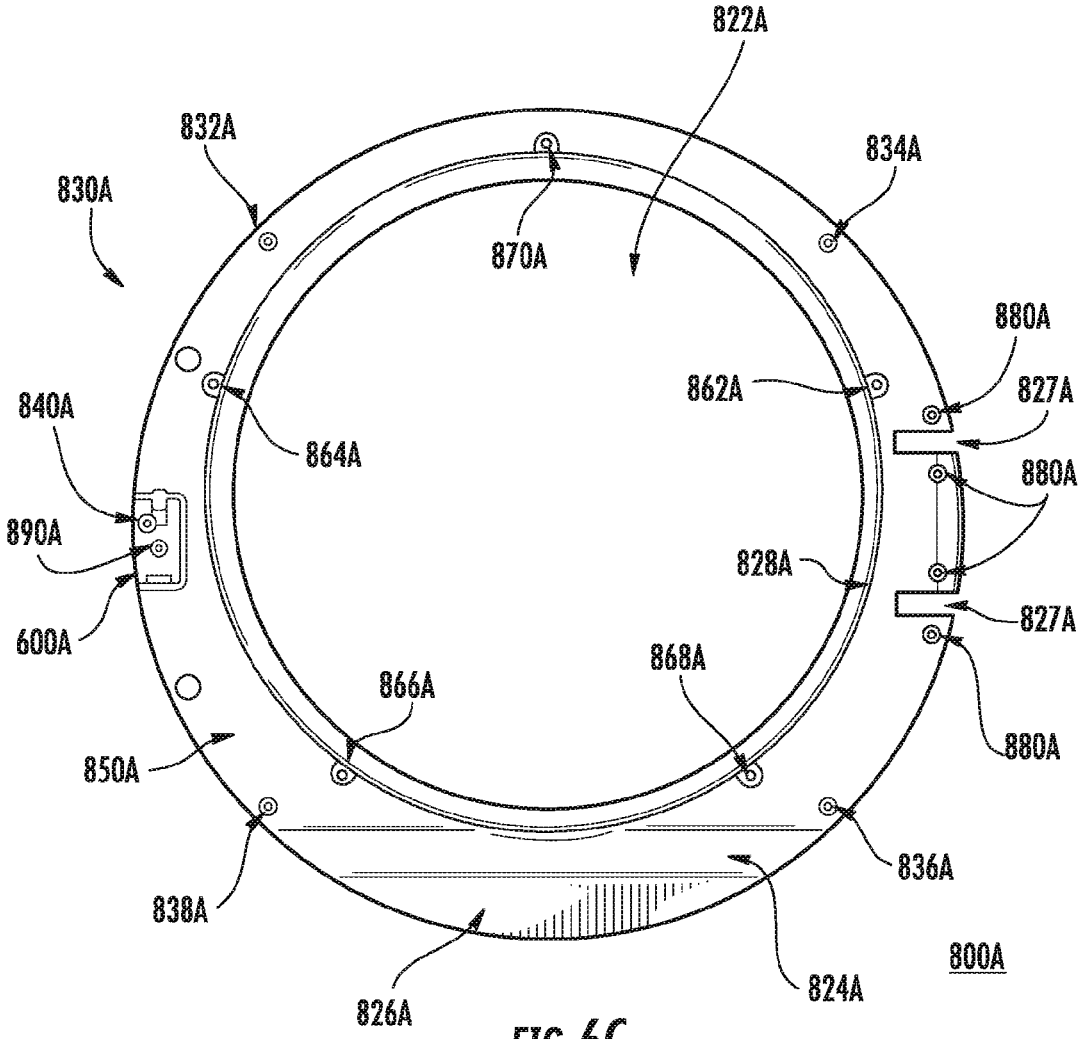
FIG. 6C illustrates a rear view of the door frame of the door of FIGS. 2A, 2B.

With reference to FIGS. 6A-6C, exemplary embodiments of a door frame 800A, for example for a washer 10, will now be described.

As shown in FIGS. 6A-6C, an exemplary embodiment of the door frame 800A can have a substantially circular shape when viewed from the front. However, other shapes are contemplated within the spirit and scope of the invention.

In an exemplary embodiment, the door frame 800A can be configured to have features that are particular to a washer door 100. The door frame 800A can include an opening 822A that corresponds to the see-through portion 14 of the washer door 100. The opening 822A can have, for example, a circular or oval shape, as illustrated. However, in other exemplary embodiments, the opening 822A can have other shapes.

The opening 822A can be centered (e.g., concentric) within the door frame 800A, or off-center. For example, in the exemplary embodiment illustrated, a center of the opening 822A is offset from, or above, a center of the door frame 800A such that a distance from the opening 822A to the outside edge of the door frame 800A is greater at the bottom portion of the washer door 100 than at the top portion of the washer door 100.

FIG. 6A illustrates an exemplary embodiment of the front side 810A of the door frame 800A. FIG. 6B illustrates an exemplary embodiment of the rear side 830A of the door frame 800A.

The front side 810A of the door frame 800A can include a ring portion 820A. The rear side 830A of the door frame 800A can include a ring portion 850A.

As shown in FIGS. 6A-6C, the rear side 830A of the door frame 800A can include a tapered or sloped surface 824A leading from the surface of the ring portion 820A to a recessed surface 826A on a lower side of the door frame 800A. The tapered or sloped surface 824A and recessed surface 826A can accommodate the shape of the housing of the washer 10.

The front side 810A of the door frame 800A also can include a corresponding tapered or sloped surface 854A leading from the surface of the ring portion 850A to a recessed surface 856A on a lower side of the door frame 800A.

As shown in FIG. 6A, the front side 810A of the door frame 800A can include a rib pattern to stabilize and strengthen the door frame 800A.

In an exemplary embodiment, the features of the door frame 800A can be configured to correspond to the features of the other components of the washer door, such as the front ring 200 and inner ring 400A. As shown in FIGS. 6A-6C, the door frame 800A can include a plurality of fastener points, such as screw points 832A, 834A, 836A, and 838A, that correspond to the locations of locating and/or clearance features 332, 334, 336, and 338 of the plastic cover panel 300 and the screw points 232, 234, 236, and 238 of the front ring 200.

The screw points 832A, 834A, 836A, and 838A can include, for example, one or more protrusions, screw bosses, partial screw bosses, or through-holes or receptacles for receiving and engaging the corresponding protrusions, screw bosses, partial screw bosses of the plastic cover panel 300 and front ring 200 in an assembled position with the door frame 800A. To assemble these components, fasteners can be inserted through the screw points 832A, 834A, 836A, and 838A of the door frame, through corresponding clearance features 332, 334, 336, and 338 of the plastic cover panel 300 and into the screw points 232, 234, 236, and 238 of the front ring 200, thereby securing the front ring 200 to the door frame 800A. The plastic cover panel 300 is captured or press fit between the front ring 200 and the inner ring 400A, thereby securing the plastic cover panel 300 to the door assembly.

In an exemplary embodiment, the door frame 800A can include one or more screw points 840A that correspond to the location of clearance features 340*a*, 340*b* or 342*a*, 342*b* of the plastic cover panel 300 and the screw points 240*a*, 240*b* of the front ring 200. These features are configured to correspond to a location of a door handle or grab handle to distribute or transfer the force applied at the handle location to the door frame 800A.

The screw points 832A, 834A, 836A, and 838A can be configured to cooperate with the features of the front ring 200 and plastic cover panel 300 such that these components only can have a single orientation for assembly. For example, one or more of the screw points 832A, 834A, 836A, and 838A can have a size different from a size of the other screw points, such that only a single orientation is possible. In this exemplary embodiment, the size of each screw point can correspond to a size of the screw points 332, 334, 336, 338, 340, 342*a*, 342*b* of the front ring 200 and plastic cover 300. In other exemplary embodiments, the screw points can have a different shape, or a different size and shape, among other things.

In the illustrated exemplary embodiment, the screw points 834A and 838A can be larger than the other screw points to accommodate both the locating features of the front ring 200 and the locating and/or clearance features 334 and 338 of the plastic cover 300, which can include an extension. The embodiments are not limited to the illustrated exemplary embodiment and other configurations are possible within the spirit and scope of the invention.

With reference again to FIGS. 6A-6C, the door frame 800A can include a plurality of screw points 862A, 864A, 866A, 868A, and 870A that correspond to the locations of fastening points (e.g., screw points) 462A, 464A, 466A, 468A, and 470A of the inner ring 400A.

In an exemplary embodiment, the screw points 862A, 864A, 866A, 868A, and 870A can be located around a perimeter of the opening 822A of the inner ring 400A. The screw points 862A, 864A, 866A, 868A, and 870A can be located closer to the opening 822A than to the outside edge of the door frame 800A. A removable ring 828A can be provided around the perimeter of the opening 822A and can include screw points corresponding to the screw points 862A, 864A, 866A, 868A, and 870A, for example, for strengthening these connections.

The disclosed exemplary embodiments of the door frame 800A have a plurality of screw points 862A, 864A, 866A, 868A, and 870A corresponding to the plurality of screw points 462A, 464A, 466A, 468A, and 470A of the inner ring 400A. However, in other exemplary embodiments, these screw points can be other types of connection points, attachments, or receptacles for receiving fasteners such as screws, bolts, plastic fasters, or the like, or for mating with other fasteners.

As explained above, the door frame 800A can include a first set of screw points 832A, 834A, 836A, and 838A that cooperate with the features of the front ring 200 and plastic cover panel 300, and a second set of screw points 862A, 864A, 866A, 868A, and 870A corresponding to the plurality of screw points 462A, 464A, 466A, 468A, and 470A of the inner ring 400A. In another exemplary embodiment, one of the first set and the second set of screw points can be recessed to reduce or eliminate possible confusion.

The door frame 800A can include hinge pockets 827A for receiving a hinge 500. In an exemplary embodiment of the washer door 10, the hinge 500 can be secured between the inner ring 400A and the washer frame 800A. In this manner, the inner ring 400A and the washer frame 800A act as a single part and the forces on the hinge 500 are transferred over both the inner ring 400A and the washer frame 800A.

Commonly, the washer door 100 may not be configured to be disassembled by the end user. Hence, the inner ring 400A and the door frame 800A can be configured to have the hinge pockets 427A and 827A on a single side of the door, such that the washer door 100 can be configured to swing in only a single direction.

In an exemplary embodiment, the hinge pockets 827A can be 180° hinge pockets formed between the inner ring 400A and the washer frame 800A. The corresponding features of the inner ring 400A and the washer frame 800A can be conical shaped features that engage one inside the other.

As shown in FIG. 6A, the door frame 800A also can include openings 880A for fastening the door frame 800A to the inner ring 400A at the location of the hinge 500.

The door frame 800A can have an opening 890A for receiving a screw boss and/or locating feature of a door hook 600A. The door frame 800A can include other features, such as one or more slots, recesses, or indentions for receiving corresponding features of the door hook 600A.

With reference to FIG. 6C, the rear side 830A of the door frame 800A will now be described.

The door frame 800A can include a plurality of screw points 862A, 864A, 866A, 868A, and 870A corresponding to the screw points 462A, 464A, 466A, 468A, and 470A of the inner ring 400A, which will be described in more detail below.

In an exemplary embodiment, the screw points 862A, 864A, 866A, 868A, and 870A can be located around a perimeter of the opening 822A of the door frame 800A. The screw points 862A, 864A, 866A, 868A, and 870A can be located closer to the opening 822A than to the outside edge of the door frame 800A.

The disclosed exemplary embodiments have a plurality of screw points (e.g., 862A, 864A, 866A, 868A, and 870A). However, in other exemplary embodiments, these screw points can be other types of connection points, attachments, or receptacles for receiving fasteners such as screws, bolts, plastic fasters, or the like, or for mating with other fasteners.

The hinge pockets 827A are configured to receiving a hinge 500. In an exemplary embodiment of the washer door 10, the hinge 500 can be secured between the inner ring 400A and the washer frame 800A.

As shown in FIGS. 6A-6C, the door frame 800A can include a tapered or sloped surface 824A leading to a recessed surface 826A on a lower side of the door frame 800A. The tapered or sloped surface 824A and recessed surface 826A can accommodate the shape of the housing of the washer 10.

With reference to FIGS. 7A to 7L, an exemplary embodiment of a door hook 600A and will now be described.

Figure 7B:
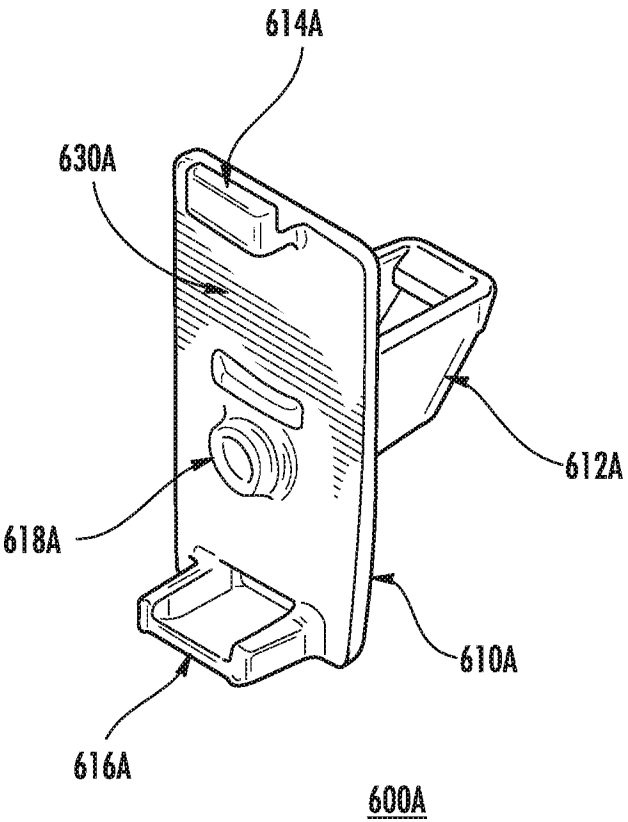
FIG. 7B illustrates a front perspective view of a door hook according to an embodiment of the invention.
Figure 7A:
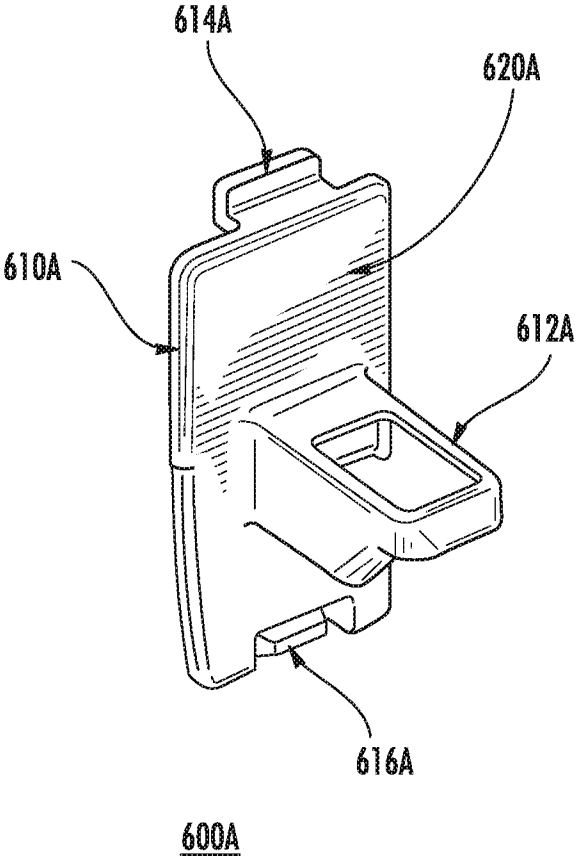
FIG. 7A illustrates a rear perspective view of a door hook according to an embodiment of the invention.
Figure 7E:
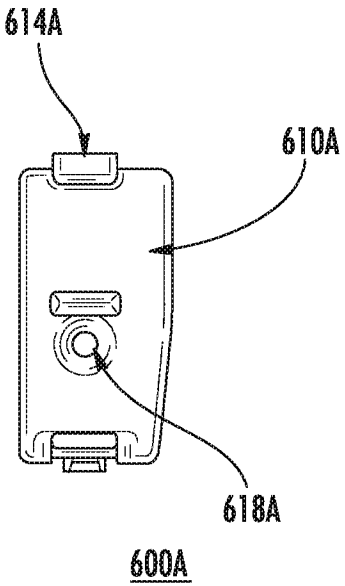
FIG. 7E illustrates a front plan view of a door hook according to an embodiment of the invention.
Figure 7D:
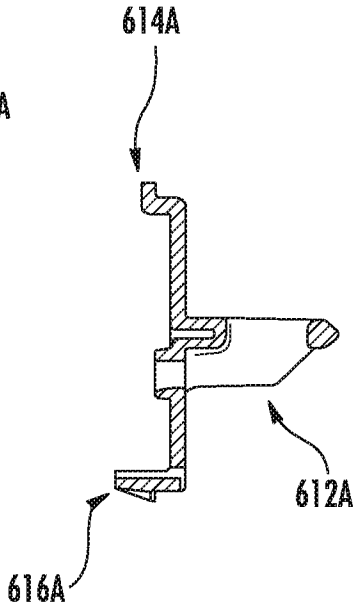
FIG. 7D illustrates a side cross-sectional view of a door hook according to an embodiment of the invention.
Figure 7C:
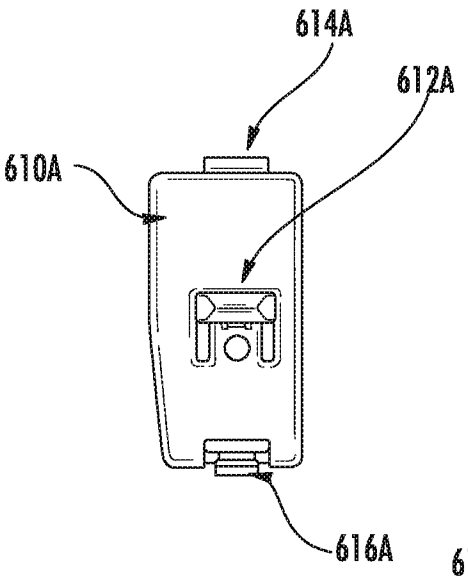
FIG. 7C illustrates a rear plan view of a door hook according to an embodiment of the invention.
Figure 7H:
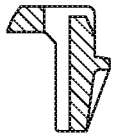
FIG. 7H illustrates a cross-sectional view of a part of a door hook according to an embodiment of the invention.
Figure 7G:
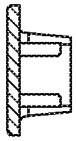
FIG. 7G illustrates a cross-sectional view of a part of a door hook according to an embodiment of the invention.
Figure 7F:
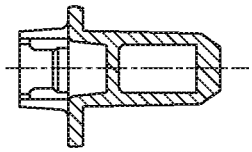
FIG. 7F illustrates a cross-sectional view of a part of a door hook according to an embodiment of the invention.

As shown in FIGS. 7A and 7B, the door hook 600A can include a base plate 610A having a front face 620A and a rear face 630A.

The front face 620A can include a striker 612A for engaging a corresponding latch or striker plate on the housing 12 of the washer 10. The rear face 630A can include a screw boss 618A. A first end, or upper end, of the base plate 610A can include a flange 614A. A flexible clip 616A can be provided on an opposite end (e.g., second end or lower end) of the base plate 610A. The flexible clip 616A can include a resilient or flexible tab or tongue that is capable of being depressed and that can spring back into its original position upon being released.

FIGS. 7C-7H illustrate details of an exemplary embodiment of the door hook 600A. The exemplary embodiments are not limited to the features illustrated in the figures and other embodiments clearly are contemplated.

With reference to FIGS. 7I-7L, exemplary embodiments of the engagement of the door hook 600A into the door hook receptacle 840A of the door frame 800A, and the manner in which the door hook 600A can be installed into the door hook receptacle 840A of the door frame 800A, will now be described.

Figure 7J:
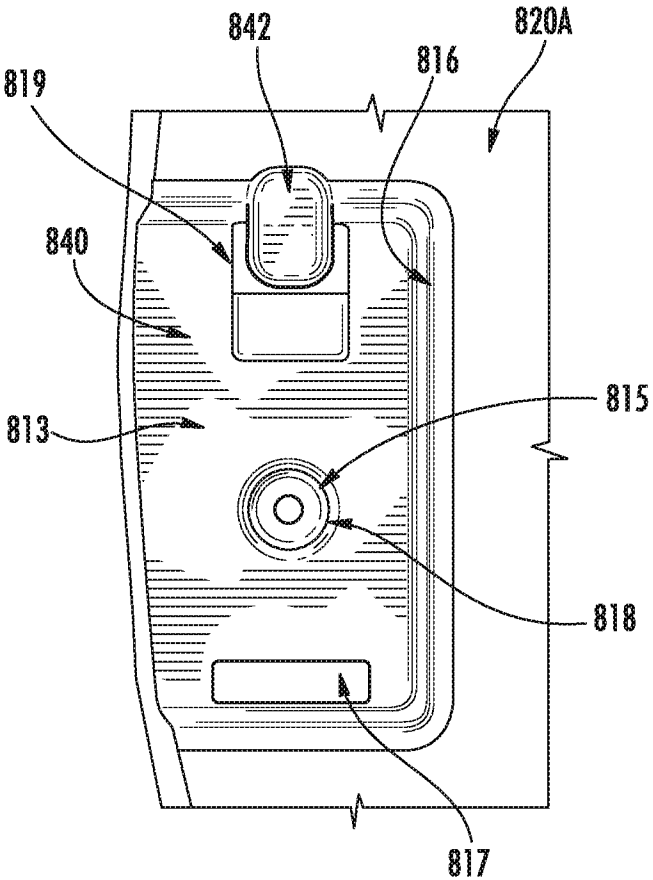
FIG. 7J illustrates a partial rear plan view of a door frame according to an embodiment of the invention.
Figure 7I:
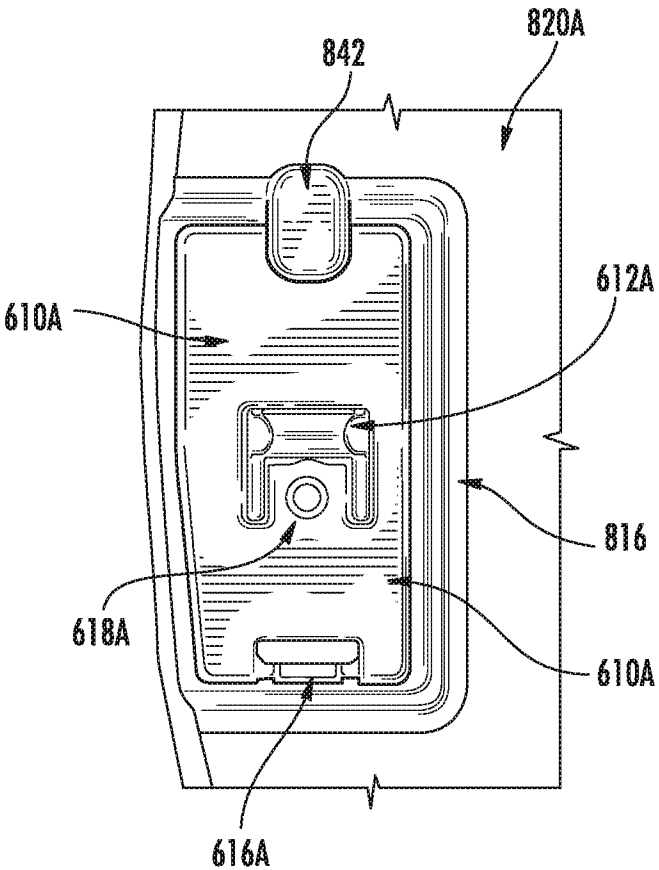
FIG. 7I illustrates a partial rear plan view of an assembled door frame and door hook according to an embodiment of the invention.

As shown in FIG. 7J, the door hook receptacle 840A can be formed in the rear face 820A of the door frame 800A. The door hook receptacle 840A can include a recessed surface 813 that can be recessed into the rear face 820A. The recessed surface 813 can be bordered by sidewalls 816, which connect the recessed surface 813 to the rear face 820A. In the illustrated exemplary embodiment, the sidewalls 816 can extend around the entire perimeter of the receptacle 840A. In other exemplary embodiment, the sidewall 816 may not extend around the entire perimeter of the receptacle 840A. The sidewalls 816 can be tapered or sloped to promote easy installation and removal of the door hook 600A from the receptacle 840A.

The receptacle 840A can include a cantilever projection 842 at a first end, or top end. A first aperture 819, such as a rectangular or square-shaped slot, can be formed in the recessed surface 813 of the receptacle 840A and under the cantilever projection 842. A second aperture 817, such as a rectangular or square-shaped slot, can be formed in the recessed surface 813 of the receptacle 840A at a second end, or lower end, of the receptacle 840A. The recessed surface 813 can include a third aperture 818. In another exemplary embodiment, the third aperture 818 can be a recessed portion. A screw receptacle 815 can be formed in the lower surface of the third aperture 818.

Figure 7L:
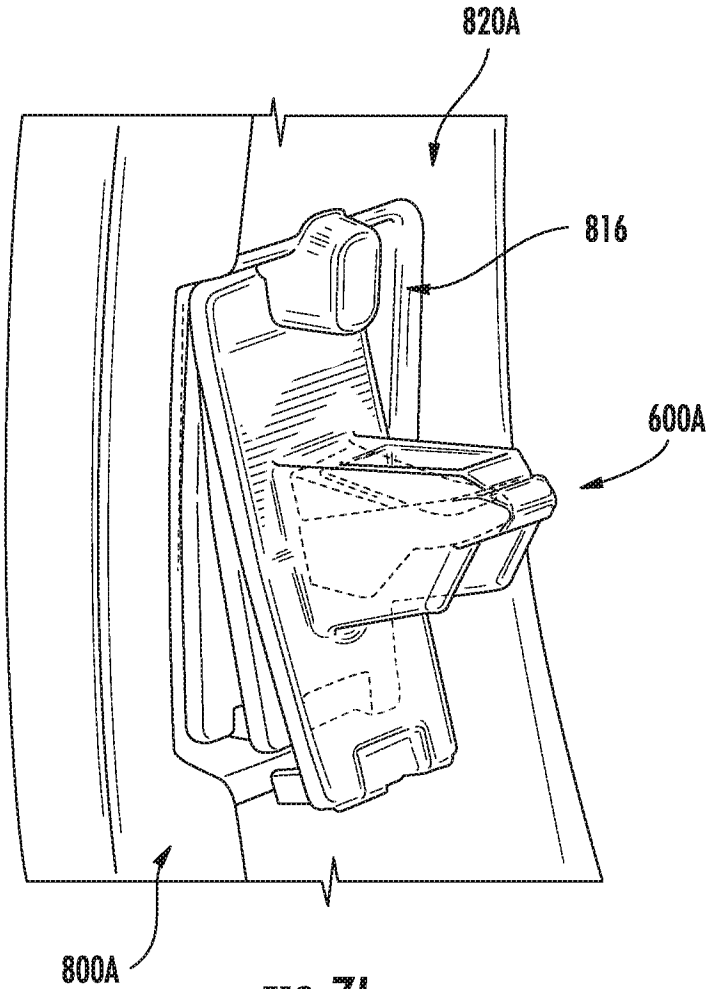
FIG. 7L illustrates partial perspective assembly view of a door frame and door hook according to an embodiment of the invention.
Figure 7K:
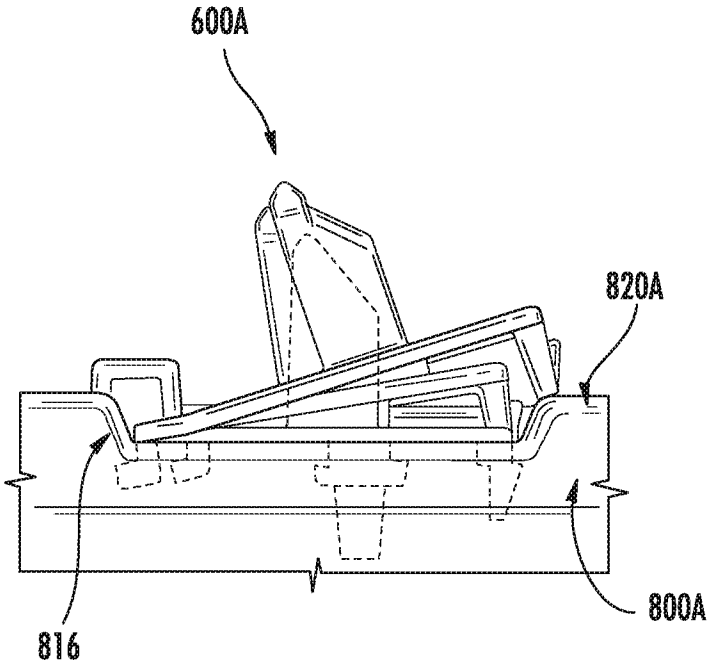
FIG. 7K illustrates partial side assembly view of a door frame and door hook according to an embodiment of the invention.

As illustrated in FIGS. 7K and 7L, in operation, the upper end of the door hook 600A can be inserted into the receptacle 840A at an angle. The flange 614A can be inserted into under the cantilever projection 842 and into the first aperture 819.

The lower end of the door hook 600A then can be lowered or pivoted into the receptacle 840A. As the door hook 600A is lowered into the receptacle 840A, the screw boss 618A can engage the third aperture 818, thereby ensuring the proper alignment of the door hook 600A in the receptacle without tools.

Next, the flexible clip 616A on the lower end of the door hook 600A can be inserted into and removably secured to the second aperture 817 of the receptacle 840A by pushing the resilient or flexible tab into the second aperture 817. The resilient tab depresses as the flexible clip is inserted into the second aperture 817 and then moves back toward its original position, thereby securing a portion of the resilient tab under a wall adjacent to the second aperture 817.

In another exemplary embodiment, a screw or other fastener can be inserted into the screw boss 618A of the door hook and the corresponding third aperture 818 and screw receptacle 815 of the receptacle 840A to fixedly secure the door hook 600A in the receptacle 840A.

In this manner, the exemplary embodiments can provide a door hook 600A that can be easily installed without tools (i.e., a tool-less attachment). The position and alignment of the door hook can be provided easily, thereby ensuring a proper alignment of the door hook 600A on the door frame 800A, and thus, a proper alignment with the latch on the housing 12 of the washer 10. Moreover, the position and alignment of the door hook 600A in the receptacle 840A can be fixed prior to inserting a fastener to secure the door hook 600A to the door frame 800A.

The present invention has been described herein in terms of several preferred embodiments. However, modifications and additions to these embodiments will become apparent to those of ordinary skill in the art upon a reading of the foregoing description. It is intended that all such modifications and additions comprise a part of the present invention to the extent that they fall within the scope of the several claims appended hereto.

Like numbers refer to like elements throughout. In the figures, the thickness of certain lines, layers, components, elements or features may be exaggerated for clarity.

The terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "lateral", "left", "right" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. The device may be otherwise oriented (rotated 90 degrees or at other orientations) and the descriptors of relative spatial relationships used herein interpreted accordingly.

What is claimed is:

1. A door hook for a door assembly of a household appliance, wherein the household appliance includes a housing having an opening for accessing an interior of the housing, a tub disposed inside the housing, the tub having a rotating drum therein for receiving laundry through the opening, the door assembly having a see-through portion for viewing into the tub, the door assembly being pivotably coupled to the housing and movable between an open position for accessing the opening of the housing and a closed position for closing the opening of the housing, the door hook comprising:

a base plate having a front face and a rear face;

a striker extending from the front face of the base plate; and a locating feature extending from the rear face of the base plate and directly opposite the striker, the locating feature eliminating variations in a location of the striker with respect to a door frame of the door assembly and aligning the striker on the door frame.

2. The door hook of claim 1, wherein the locating feature is a screw boss extending from the rear face of the base plate and directly opposite the striker.

3. The door hook of claim 2, wherein the striker includes sidewalls disposed around a perimeter of the screw boss such that the screw boss is accessible from a side of the front face of the base plate.

4. The door hook of claim 2, wherein the striker includes a portion that provides clearance such that the screw boss is accessible from a side of the front face of the base plate.

5. The door hook of claim 1, comprising:

a flange formed on a first end of the base plate; and a resilient clip formed on a second end of the base plate, wherein the first end is opposite the second end.

6. The door hook of claim 5, wherein the resilient clip includes a tab that is capable of being depressed from an original position and springing back toward the original position upon being released.

7. The door hook of claim 1, wherein the household appliance is a washer.

8. A household appliance comprising:

a housing having an opening for accessing an interior of the housing;

a tub disposed inside the housing, the tub having a rotating drum therein for receiving laundry through the opening; and a door assembly having a see-through portion for viewing into the tub, the door assembly being pivotably coupled to the housing and movable between an open position for accessing the opening of the housing and a closed position for closing the opening of the housing, wherein the door assembly includes:

a door frame including:

a front face having an outside edge and an inside edge, wherein the inside edge defines an opening in the front face that substantially corresponds to a shape of the opening of the housing;

a rear face on an opposite side of the door frame from the front face; and a door hook receptacle on the rear face; and a door hook secured to the door hook receptacle, wherein the door hook includes:

a base plate having a front face and a rear face;

a striker extending from the front face of the base plate; and a locating feature extending from the rear face of the base plate and directly opposite the striker, the locating feature eliminating variations in a location of the striker with respect to the door frame of the door assembly and aligning the striker on the door frame.

9. The household appliance of claim 8, wherein the locating feature is a screw boss extending from the rear face of the base plate and directly opposite the striker.

10. The household appliance of claim 9, wherein the striker includes sidewalls disposed around a perimeter of the screw boss such that the screw boss is accessible from a side of the front face of the base plate.

11. The household appliance of claim 10, wherein the first aperture includes a screw receptacle, the household appliance further comprising a screw disposed between the sidewalls of the striker and extending through the screw boss of the door hook and into the screw receptacle of the door hook receptacle.

12. The household appliance of claim 9, wherein the striker includes a portion that provides clearance such that the screw boss is accessible from a side of the front face of the base plate.

13. The household appliance of claim 8, wherein the door hook includes:

a flange formed on a first end of the base plate; and a resilient member formed on a second end of the base plate, wherein the first end is opposite the second end.

14. The household appliance of claim 13, wherein the resilient member includes:

a resilient clip that is capable of being depressed from an original position and springing back toward the original position upon being released.

15. The household appliance of claim 13, wherein the door hook receptacle includes a first aperture that engages the locating feature of the door hook in an installed position.

16. The household appliance of claim 15, wherein the first aperture includes a screw receptacle.

17. The household appliance of claim 16, comprising:

a screw extending through the locating feature of the door hook and into the screw receptacle of the door hook receptacle.

18. The household appliance of claim 15, wherein the door hook receptacle includes a recessed surface that receives the base plate of the door hook in an assembled position, and wherein the first aperture is formed in the recessed surface.

19. The household appliance of claim 18, wherein the door hook receptacle includes a tapered sidewall.

20. The household appliance of claim 18, wherein the door hook receptacle includes:

a cantilever projection at a first end of the door hook receptacle; and a second aperture formed in the recessed surface, the cantilever projection extending from the recessed surface and over an opening of the second aperture such that a portion of the opening of the second aperture is disposed under the cantilever projection, wherein the flange of the door hook is inserted into the second aperture and a portion of the base plate is disposed under the cantilever projection in an assembled position.

21. The household appliance of claim 20, wherein the door hook receptacle further includes:

a third aperture in the recessed surface at a second end, wherein the resilient member of the door hook is inserted into the third aperture and engaged with an adjacent surface of the third aperture in the assembled position.

22. The household appliance of claim 20, wherein the first aperture includes a screw receptacle, the household appliance further comprising a screw extending through the locating feature of the door hook and into the screw receptacle of the door hook receptacle.

23. The household appliance of claim 18, wherein the door hook receptacle includes:

a third aperture in the recessed surface at a second end, wherein the resilient member of the door hook is inserted into the third aperture and engaged with an adjacent surface of the third aperture in an assembled position.

24. The household appliance of claim 8, wherein the household appliance is a washer.

25. The household appliance of claim 8, wherein the striker engages the housing of the household appliance and secures the door assembly in the closed position.

26. The household appliance of claim 8, wherein the housing includes a door hook receptacle adjacent to the opening of the housing; and wherein the striker engages the door hook receptacle of the housing and secures the door assembly against the housing when the door assembly is in the closed position.

* * * * *